US007813689B2

(12) United States Patent
Nakamura et al.

(10) Patent No.: US 7,813,689 B2
(45) Date of Patent: Oct. 12, 2010

(54) FIXING DEVICE AND IMAGE FORMING APPARATUS

(75) Inventors: Takuma Nakamura, Kanagawa (JP); Yasuo Katano, Kanagawa (JP); Tsuneo Kurotori, Tokyo (JP); Tomoyasu Hirasawa, Tokyo (JP); Takeshi Saitoh, Tokyo (JP); Yuko Arizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 377 days.

(21) Appl. No.: 11/898,046

(22) Filed: Sep. 7, 2007

(65) Prior Publication Data

US 2008/0069612 A1 Mar. 20, 2008

(30) Foreign Application Priority Data

Sep. 8, 2006 (JP) ..... 2006-244868
May 2, 2007 (JP) ..... 2007-121476

(51) Int. Cl.
*G03G 15/20* (2006.01)

(52) U.S. Cl. ..... 399/340

(58) Field of Classification Search ..... 399/340, 399/122, 320, 321
See application file for complete search history.

(56) References Cited

U.S. PATENT DOCUMENTS

| | | | | |
|---|---|---|---|---|
| 3,158,509 | A | 11/1964 | Hudson | |
| 5,155,531 | A | 10/1992 | Kurotori et al. | |
| 5,164,778 | A | 11/1992 | Tanabe et al. | |
| 5,809,388 | A | 9/1998 | Inada et al. | |
| 6,947,700 | B2 | 9/2005 | Kurotori et al. | |
| 2006/0115762 | A1 | 6/2006 | Katano et al. | |
| 2006/0133866 | A1* | 6/2006 | Asakura et al. | 399/320 |
| 2006/0263712 | A1 | 11/2006 | Katano et al. | |
| 2007/0098469 | A1 | 5/2007 | Yoshino et al. | |
| 2007/0147913 | A1 | 6/2007 | Katano et al. | |

FOREIGN PATENT DOCUMENTS

| | | |
|---|---|---|
| JP | 40-10867 | 6/1940 |
| JP | 07-044034 | 2/1995 |
| JP | 2004-109747 | 4/2004 |
| JP | 2004-109751 | 4/2004 |
| JP | 2004-294847 | 10/2004 |
| JP | 2004-333866 | 11/2004 |
| JP | 2006-133306 | 5/2006 |
| JP | 2006-163083 | 6/2006 |
| JP | 2006-293169 | 10/2006 |
| JP | 2006/350099 | 12/2006 |

* cited by examiner

*Primary Examiner*—David M Gray
*Assistant Examiner*—Andrew V Do
(74) *Attorney, Agent, or Firm*—Harness, Dickey & Pierce, P.L.C.

(57) ABSTRACT

A disclosed fixing device fixes unfixed toner onto a recording sheet with the use of toner fixing liquid including a softening agent for softening toner. The fixing device includes a sprayer configured to spray the toner fixing liquid as liquid droplets and a liquid droplet charging unit configured to apply an electric charge to the sprayed liquid droplets. The sprayer sprays the liquid droplets onto the unfixed toner placed on the recording sheet. The liquid droplet charging unit applies, to the sprayed liquid droplets, an electric charge of an electric charge polarity that is the same as that of the unfixed toner.

9 Claims, 19 Drawing Sheets

FIG.3

| DRIVING FREQUENCY | AVERAGE DROPLET DIAMETER |
|---|---|
| 300KHz | 10 μm |
| 500KHz | 7 μm |
| 800KHz | 5 μm |
| 1000KHz(1MHz) | 4 μm |

APPLICATION AMOUNT AND NECESSARY DROPLET DIAMETER FOR APPLICATION WITHOUT IRREGULARITIES

FIXING DEVICE AND IMAGE FORMING APPARATUS

BACKGROUND OF THE INVENTION

1. Field of the Invention

The present invention relates generally to image forming apparatuses such as a copier, a printer, a facsimile machine, and a multifunction peripheral including these functions, and more particularly to an image forming apparatus employing an electrophotographic method, in which a toner image is formed on an image carrier by performing charging, writing, and developing, the toner image is directly transferred or indirectly transferred via an intermediate transfer body onto a recording material, and the transferred toner image is fixed with a fixing device, thereby recording an image onto the recording material such as a sheet. Furthermore, the present invention relates generally to fixing devices included in such image forming apparatuses for fixing unfixed toner onto the recording material after the toner image is transferred, and more particularly to a fixing device for fixing the toner image onto the recording material by applying fixing liquid while the recording material is being conveyed.

2. Description of the Related Art

Presently, there is a wide variety of apparatuses, such as copiers, printers, and facsimile machines, for forming an image on a recording sheet (recording material), such as a sheet, a cloth, or an OHP transparency, according to image information. Among them, the predominant type of apparatus employs the electrophotographic method in which toner is used to form an image on plain paper at high speed and with high density and high precision. Furthermore, in recent years and continuing, these electrophotographic image forming apparatuses can conveniently create color images, and are thus being widely used in offices.

In the image forming apparatus employing the electrophotographic method, a charging device, a writing device, a developing device, a transfer device, a cleaning device, and a charge eliminator are arranged around an image carrier that is drum-shaped or belt-shaped. As the image carrier rotates, a charging operation is performed and then a writing operation is performed so that an electrostatic latent image is formed on the surface of the image carrier. The electrostatic latent image is then developed by causing toner to adhere to the latent image, thus creating a toner image on the image carrier. Then, the toner image is directly transferred or indirectly transferred via a belt-like intermediate transfer body onto a recording material, thereby recording an image on the recording material. After the toner image has been transferred, the transfer material is conveyed to a fixing device, and the unfixed toner is fixed on the recording material. Meanwhile, after the image has been transferred, the surface of the image carrier is cleaned by the cleaning device and static electricity is eliminated from the surface of the image carrier, so that the image carrier is prepared for another image forming operation.

In the electrophotographic method, heat is often employed for the fixing operation, because the fixing speed is fast and the image quality of the fixed image is high. Specifically, a heating element such as a halogen heater or a ceramic heater is used to heat a roller or a film. A recording sheet on which unfixed toner is placed is sandwiched by a pair of fixing rollers (heating rollers and pressurizing rollers) to be heated and pressurized. Accordingly, the toner is dissolved and deformed in such a manner as to be fixed onto the recording sheet by being anchored to the fiber of the recording sheet.

This method is widely used due to its superior uniformity and reliability. However, the problem with this method is excessive power consumption. In recent years and continuing, energy conservation is an important issue. Thus, there are considerable requirements for low-power-consuming fixing devices, instead of those that employ the heat fixing method. Furthermore, fixing devices that employ the heat fixing method require a long time to start up before commencing the fixing operation. Conventionally, there have been proposed techniques for mitigating this problem or to improve various existing fixing methods (see, for example, Patent Documents 1 through 10).

As described in Patent Document 1, there have long been two fixing methods, i.e., a heating method and a steam fixing method. In the steam fixing method, a recording sheet on which unfixed toner is placed is inserted into solvent vapor. This method surely consumes less power than the heating method, but did not become widespread because the liquid has an unpleasant odor and may harm the human body. However, a new type of liquid has been recently developed. This liquid is odorless, harmless, and is capable of causing toner to expand, dissolve, and to be fixed on sheets. Therefore, the fixing method employing liquid is attracting attention once again.

As color copiers have become predominant, multiple layers of toner are often superposed onto a recording sheet, so that the total height of toner becomes 20 μm through 25 μm. Assuming that the entire A4-sized sheet is covered with a solid image containing layers of toner as high as this, there needs to be enough fixing liquid for filling all of the gaps in the toner. Experimental results show that the required amount of fixing liquid is approximately 1 milliliter per A4-sized sheet. Accordingly, in order to fix toner onto 10,000 sheets, 10 liters of fixing liquid are necessary, which would require a huge tank. Furthermore, a curling phenomenon would occur, in which one side of the recording sheet expands and warps because of the liquid. As a result, the quality of printouts is significantly decreased.

Patent Document 2 describes a method for reducing the amount of liquid used. This method attempts to reduce the required amount of liquid by applying the liquid only onto portions where an image is formed, and not applying the liquid onto portions without any images.

Patent Documents 3 through 5 describe a technology for jetting fixing liquid onto a toner image on the recording sheet and then performing a pressurizing step, a technology for charging capsules containing fixing liquid and inducing them to an electrode arranged on a side opposite to a supplying unit, and a technology for turning the fixing liquid into a mist including microscopic liquid droplets of around 0.5 μm through 5 μm.

However, in the method described in Patent Document 2, the fixing liquid is applied according to image position information, and therefore, it is difficult to cause the fixing liquid to adhere at precise positions. As a result, the configuration becomes complex. Furthermore, the fixing liquid is not applied to toner on background stains, which do not corresponding to image position information. Hence, the toner of the background stains will be in an unfixed status on the ejected sheet. As a result, the unfixed toner may soil the user and/or the surrounding environment.

In the method described in Patent Document 4, toner capsules are charged, and a line-type electrode is provided behind the recording sheet. The line-type electrode applies a voltage onto the recording sheet according to image signals in order to pull the toner capsules. This configuration is complex, and selections can only be made in units of lines.

Patent Document 6 describes a fixing device that uses odorless and harmless fixing liquid. Specifically, the fixing liquid includes a softening agent for softening toner and a solvent for dispersing or dissolving the softening agent. This fixing liquid is sprayed or dripped, or applied with the use of a roller, so that the fixing liquid adheres to a recording material onto which an image has been transferred. The fixing liquid softens the toner, and then the fixing liquid is dried so that the unfixed toner is fixed onto the recording material.

The fixing device employing this method does not require a toner heating process as in the case of the heat fixing method. Accordingly, this method consumes low power, and is thus appropriate for energy conservation measures. However, various problems arise due to applying a large amount of fixing liquid onto the recording material.

Specifically, the problems are described in the following. 1) If water is used as the solvent in the fixing liquid, a large amount of water will expand the fiber in the sheet of paper used as the recording material. As a result, the dissolved toner will reach the back side of the recording material, i.e., the image will ooze through to the back side, thus degrading image quality. 2) If a large amount of this water is absorbed, the recording material will be wrinkled or curled. This will have a significantly adverse effect on the operation performed by the image forming apparatus of conveying the recording material in a reliable manner and at high speed. 3) In order to remove a large amount of this water by causing it to evaporate with the use of a drying device, the amount of power consumption will be the same as that used in the heat fixing method. 4) Because a large amount of fixing liquid is used, it is necessary to frequently replace the fixing liquid. If a large-capacity fixing liquid tank is used, the fixing device will need to be large. For this reason, a compact-sized image forming apparatus may not be realized.

In order to solve the above problems 1) through 4), several fixing methods have been conventionally proposed. For example, Patent Documents 7 and 10 describe inkjet methods in which the fixing liquid is applied only to the toner image based on position information of the toner image on the recording material or position information on the toner image on the image carrier before being transferred onto the recording material. However, with this method, the fixing liquid needs to be accurately applied according to the image data in units of the toner, which is difficult to realize.

In a fixing device described in Patent Document 6, if liquid droplets actually strongly strike the toner, the toner will be forced to move, because the toner is adhering to the recording material only by static electricity. As a result, the toner image on the recording material will be distorted. Accordingly, Patent Documents 8 and 9 propose a transfer fixing device. Specifically, the fixing liquid that has been turned into liquid droplets is charged, and then caused to adhere to a secondary transfer roller. The fixing liquid is caused to adhere to toner on the secondary transfer roller by a Coulomb force. Then, the toner is transferred onto a recording material together with the fixing liquid droplets, to be fixed on the recording material. By employing this method, small droplets strike the toner at a relatively low speed, and therefore, the kinetic energy is small and the toner is prevented from being moved.

In such a conventional fixing device, the fixing liquid droplets adhering to the secondary transfer roller are directly transferred together with the toner onto the recording material so that the toner is fixed onto the recording material. However, in order to reliably fix the toner, a considerable amount of fixing liquid droplets needs to be applied to the recording material. As a result, the surface of the recording material will become wet, and the recording material will become curled.

Patent Document 1: Japanese Published Examined Patent Application No. S40-10867

Patent Document 2: Japanese Laid-Open Patent Application No. 2004-109751

Patent Document 3: Japanese Laid-Open Patent Application No. 2004-294847

Patent Document 4: Japanese Laid-Open Patent Application No. 2006-133306

Patent Document 5: Japanese Laid-Open Patent Application No. 2004-333866

Patent Document 6: Japanese Patent No. 3290513

Patent Document 7: Japanese Laid-Open Patent Application No. 2004-109747

Patent Document 8: Japanese Laid-Open Patent Application No. 2006-163083

Patent Document 9: Japanese Laid-Open Patent Application No. 2006-293169

Patent Document 10: Japanese Laid-Open Patent Application No. 2006-350099

SUMMARY OF THE INVENTION

The present invention provides a fixing device and an image forming apparatus in which one or more of the above-described disadvantages are eliminated.

A preferred embodiment of the present invention provides a fixing device and an image forming apparatus employing the same that are capable of causing fixing liquid to automatically adhere only to portions with toner, do not require position information, do not require accurate precision in adjusting the positions to which the fixing liquid adheres, and can thus be configured at low cost.

Furthermore, a preferred embodiment of the present invention provides an energy-saving fixing device employing odorless and harmless toner fixing liquid that is made from a softening agent and a solvent for dissolving or dispersing the softening agent, and therefore, when the fixing liquid is applied to unfixed toner, the unfixed toner is softened by the softening agent and fixed to a recording material, so that a toner image on the recording material is prevented from being distorted, and the recording material is prevented from curling because an appropriate amount of the fixing liquid is applied.

Furthermore, a preferred embodiment of the present invention enables efficient use of the fixing liquid because an appropriate amount of fixing liquid is applied, and also eliminates fixing irregularities because the fixing liquid is uniformly applied on the toner image.

Furthermore, a preferred embodiment of the present invention enables preferable fixing operations by reliably and stably conveying a recording material on which unfixed toner is placed.

Furthermore, a preferred embodiment of the present invention reliably eliminates a curling phenomenon of the recording material by causing the fixing liquid to have equal liquid densities on the front and back sides of the recording material.

Furthermore, a preferred embodiment of the present invention reliably causes the unfixed toner and fixing liquid droplets to adhere to the recording material.

Furthermore, a preferred embodiment of the present invention enables efficient use of the fixing liquid by enhancing fixing efficiency.

Furthermore, a preferred embodiment of the present invention provides an image forming apparatus equipped with a fixing device in which a toner image on the recording material is prevented from being distorted and the recording material is prevented from curling by applying an appropriate amount of the fixing liquid.

An embodiment of the present invention provides a fixing device for fixing unfixed toner onto a recording sheet with the use of toner fixing liquid including a softening agent for softening toner, the fixing device including a sprayer configured to spray the toner fixing liquid as liquid droplets; and an electrode configured to apply an electric charge to the sprayed liquid droplets, wherein the sprayer sprays the liquid droplets onto the unfixed toner placed on the recording sheet; and the electrode applies, to the sprayed liquid droplets, an electric charge of an electric charge polarity opposite to that of the unfixed toner.

An embodiment of the present invention provides a fixing device for fixing unfixed toner onto a recording material by applying toner fixing liquid, the toner fixing liquid including a softening agent for softening the unfixed toner and a solvent for dissolving or dispersing the softening agent, the fixing device including a sprayer configured to spray the toner fixing liquid as fixing liquid droplets; a liquid droplet charging unit configured to apply, to the fixing liquid droplets sprayed by the sprayer, an electric charge of the same polarity as that of the unfixed toner; a medium conveying unit configured to convey the recording material on which the unfixed toner is placed through an atmosphere including the fixing liquid droplets to which the electric charge is applied by the liquid droplet charging unit; and a recording material charging unit configured to charge the recording material being conveyed by the medium conveying unit to a polarity opposite to those of the unfixed toner and the fixing liquid droplets.

According to one embodiment of the present invention, a fixing device and an image forming apparatus are provided, in which an electric charge having a polarity opposite to that of unfixed toner is injected into fixing liquid so that the sprayed fixing liquid is pulled to the unfixed toner by a Coulomb force and adheres to the unfixed toner, but none of or only a small amount of the sprayed fixing liquid adheres to portions without the unfixed toner, and therefore, on-demand application can be performed automatically.

Furthermore, according to one embodiment of the present invention, unfixed toner placed on a recording material electrostatically adheres to the recording material that is charged to an opposite polarity. Therefore, the unfixed toner on the recording material is prevented from scattering, an unfixed toner image on the recording material is prevented from being distorted, and a preferable fixing operation can be performed without degrading the image quality. Moreover, fixing liquid droplets electrostatically adhere to the recording material charged to the opposite polarity in such a manner as to be uniformly applied to the recording material. Accordingly, fixing irregularities can be eliminated and the fixing liquid can be efficiently used so that consumption of the fixing liquid is reduced. Additionally, fixing liquid droplets adhering to the recording material are caused to further permeate to the back side of the recording material by being pulled by an electrostatic force, so that the fixing liquid has equal liquid densities on the front and back sides of the recording material, thus reducing a curling phenomenon of the recording material.

Furthermore, according to one embodiment of the present invention, the sprayer sprays the toner fixing liquid as fixing liquid droplets with diameters having a mode value of 15 μm or less; the sprayed fixing liquid droplets uniformly float in midair as a dry mist, and adhere to the recording material without being wasted and without causing fixing irregularities. Accordingly, the fixing liquid droplets adhere to the recording material without being wasted so that the fixing liquid can be efficiently used and fixing irregularities can be eliminated.

Furthermore, according to one embodiment of the present invention, rollers are driven so that a conveying belt is conveyed and a recording material electrostatically adhering to the conveying belt is conveyed by the conveying belt. Accordingly, the recording sheet on which the unfixed toner is placed can be reliably and stably conveyed through the atmosphere with charged fixing liquid droplets.

Furthermore, according to one embodiment of the present invention, a power source applies a voltage to an electrode provided on the inside of the conveying belt so that the recording material conveyed by the conveying belt can be charged to a polarity opposite to that of the unfixed toner and the fixing liquid droplets. Hence, by a pulling force from the back side of the recording material, the fixing liquid droplets adhering to the recording material are caused to further permeate to the back side of the recording material. Consequently, the fixing liquid is made to have equal liquid densities on the front and back sides of the recording material, thus reducing a curling phenomenon of the recording material.

Furthermore, according to one embodiment of the present invention, an application unit applies an electric charge to the conveying belt, so that a recording material conveyed by the conveying belt is charged to a polarity opposite to that of the unfixed toner and the fixing liquid droplets. Accordingly, the unfixed toner and the fixing liquid droplets can reliably adhere by an electrostatic force to the recording material charged to an opposite polarity.

Furthermore, according to one embodiment of the present invention, a sprayer sprays the fixing liquid droplets into a spray chamber, a liquid droplet charging unit applies an electric charge to the fixing liquid droplets so that the spray chamber is filled with the fixing liquid droplets charged to the same polarity as that of the unfixed toner, and a medium conveying unit conveys the recording material through the atmosphere with the fixing liquid droplets in the spray chamber. As the region in which the fixing liquid droplets are sprayed is partitioned, the fixing liquid droplets are prevented from scattering, thus enhancing the fixing efficiency so that the fixing liquid is used efficiently.

Furthermore, according to one embodiment of the present invention, an appropriate amount of small fixing liquid droplets are sprayed in accordance with the area on the recording material that needs to be covered by the fixing liquid, the sprayed fixing liquid droplets uniformly float in midair as a dry mist, and the fixing liquid droplets adhere to the recording material without being wasted and without causing fixing irregularities. Accordingly, fixing irregularities can be eliminated and the fixing droplets can be applied to the recording material without being wasted so that the fixing liquid can be efficiently used and consumption of the fixing liquid is reduced.

Furthermore, according to one embodiment of the present invention, an image forming apparatus having the following configuration is provided. That is, in a fixing device employed in the image forming apparatus, unfixed toner placed on a recording material electrostatically adheres to the recording material that is charged to an opposite polarity. Therefore, the unfixed toner on the recording material is prevented from scattering, an unfixed toner image on the recording material is prevented from being distorted, and a preferable fixing operation can be performed without degrading the image quality. Moreover, in the fixing device, fixing liquid droplets electrostatically adhere to the recording material charged to the opposite polarity in such a manner as to be uniformly applied to the recording material. Accordingly, fixing irregularities can be eliminated and the fixing liquid can be efficiently used so that consumption of the fixing liquid is reduced. Additionally, in the fixing device, fixing liquid droplets adhering to the recording material are caused to further permeate to the back side of the recording material by being pulled by an electrostatic force, so that the moisture has equal densities on the front and back sides of the recording material, thus reducing a curling phenomenon of the recording material.

BRIEF DESCRIPTION OF THE DRAWINGS

Other objects, features and advantages of the present invention will become more apparent from the following detailed description when read in conjunction with the accompanying drawings, in which:

FIG. 3 is a table indicating relationships between driving frequencies and average liquid droplet diameters;

DETAILED DESCRIPTION OF THE PREFERRED EMBODIMENTS

A description is given, with reference to the accompanying drawings, of an embodiment of the present invention.

Figure 1:
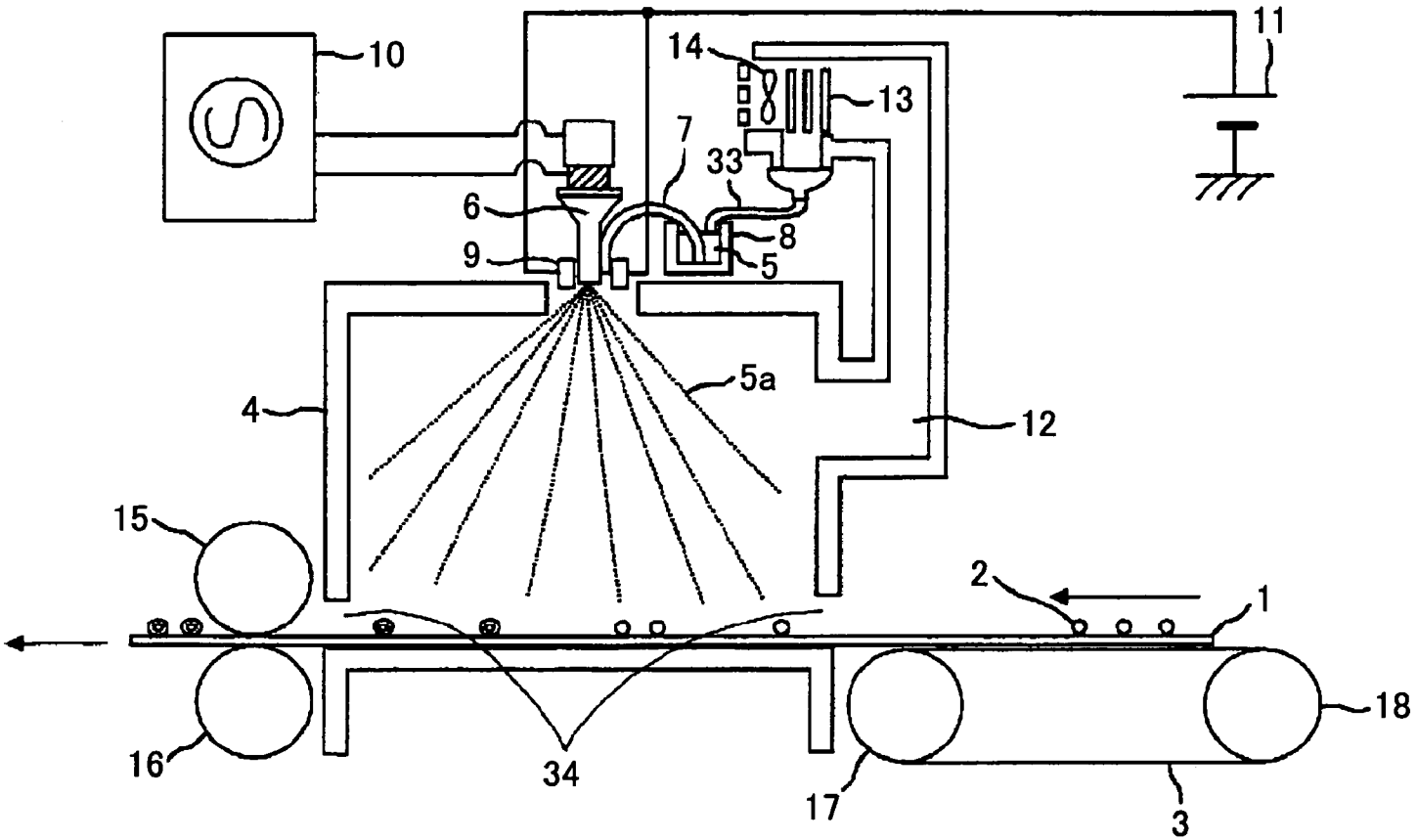
FIG. 1 is a schematic diagram of a fixing device according to an embodiment of the present invention.
Figure 2:
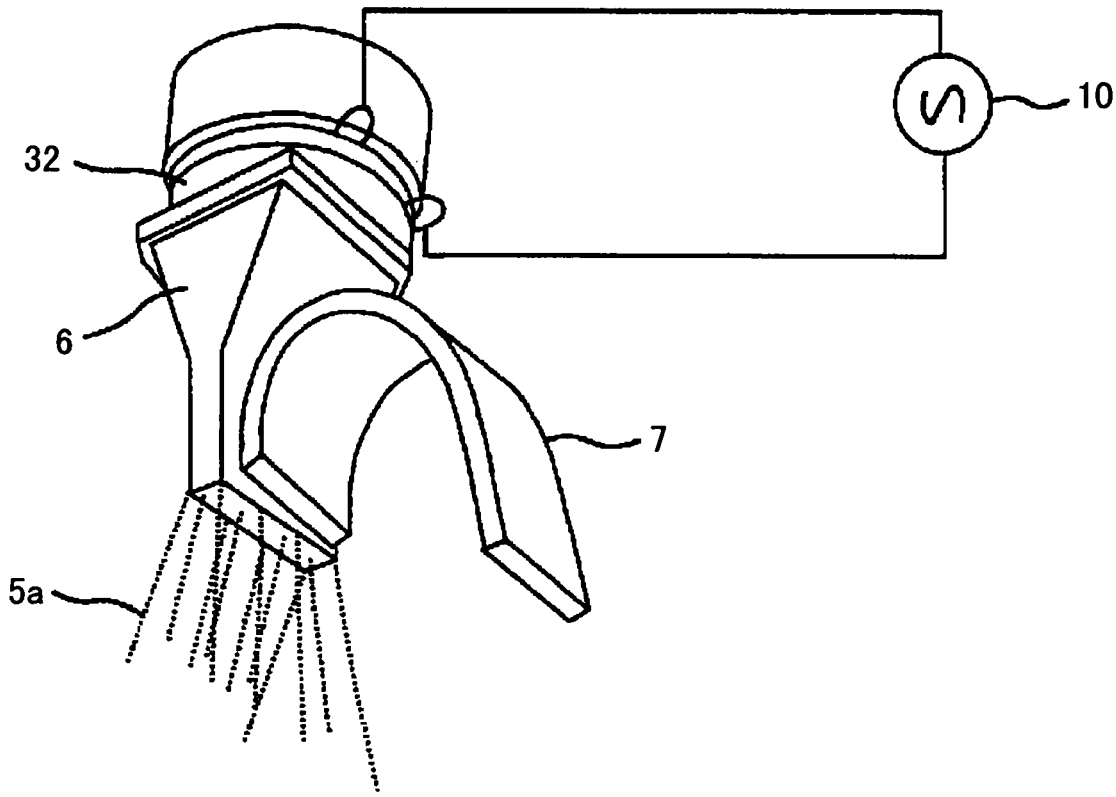
FIG. 2 is an enlarged schematic perspective view of a sprayer of the fixing device shown in FIG.

FIG. 1 is a schematic diagram of a fixing device according to an embodiment of the present invention. FIG. 2 is an enlarged schematic perspective view of a sprayer of the fixing device.

In an embodiment of the present invention, toner is fixed onto a recording sheet 1 by using toner fixing liquid 5. The toner fixing liquid 5 is formed by dissolving or dispersing a toner softening agent in a solvent. By causing an appropriate amount of this toner fixing liquid 5 to adhere onto the toner, the toner is dissolved and fixed onto the recording sheet 1.

An embodiment of the present invention is further described with reference to FIG. 1. Unfixed toner 2 is placed on the recording sheet 1 at a not shown image forming unit. This recording sheet 1 is conveyed from the right side toward the left side as viewed in FIG. 1 by a conveying belt 3 wound around a roller 17 and a roller 18. The unfixed toner 2 is negatively charged due to a final process in the image forming unit.

The recording sheet 1 enters a spray chamber 4. The spray chamber 4 includes a sprayer 6. This sprayer 6 is driven by an alternating-current power source 10. As shown in FIG. 2, an alternating-current voltage is applied from the power source 10 to a piezo element 32, so that microscopic displacement occurs on both sides of the piezo element 32. Because the sprayer 6 has a horn shape, the displacement is enhanced and becomes maximum at the leading edge of the sprayer 6.

A fixing liquid inducing element 7 is made of a sponge. One end of the fixing liquid inducing element 7 is dipped into the toner fixing liquid 5 inside a fixing liquid bottle 8 shown in FIG. 1. Accordingly, due to a capillary phenomenon, the entire fixing liquid inducing element 7 becomes soaked with the toner fixing liquid 5. By causing the other end of the fixing liquid inducing element 7 to contact the tip of the sprayer 6, the fixing liquid 5 turns into liquid droplets 5*a* due to oscillation, and is sprayed into midair.

An electrode 9 shown in FIG. 1 is positively charged by a direct-current power source 11. The toner fixing liquid 5 to be sprayed passes near this electrode 9, and therefore, the liquid droplets 5*a* of the toner fixing liquid 5 become positively charged. The sprayed liquid droplets 5*a* do not drop but float within the spray chamber 4 due to an air current.

When the recording sheet 1 on which the unfixed toner 2 is placed enters the spray chamber 4, the liquid droplets 5*a* are drawn to the negatively charged toner due to a Coulomb force. Accordingly, the liquid droplets 5*a* do not adhere to portions without any toner and the toner fixing liquid 5 adheres only onto portions with the toner. Hence, the toner fixing liquid 5 is automatically applied in an on-demand manner.

Thus, only a small amount of fixing liquid is required, so that the recording sheet 1 is prevented from curling or cockling and the quality of the recording sheet 1 is maintained. Furthermore, the configuration is simple compared to a method of storing image position information and applying the fixing liquid onto target positions. If there is toner adhering as background stains, which are not included in image position information, fixing liquid droplets adhere to these stains and fix them onto the sheet. This prevents a situation where an ejected sheet has unfixed toner on it, and the unfixed toner soils the user and/or the surrounding environment. Accordingly, an embodiment according to the present invention provides an advantageous on-demand application method.

If the diameter of the liquid droplets 5*a* is too large, the liquid droplets 5*a* will drop and adhere onto the entire recording sheet 1, thus spoiling the recording sheet 1. If the diameter of the liquid droplets 5*a* is too small, a long time will be required to apply the amount necessary for dissolving the toner. Experimental results show that the liquid droplets preferably have a diameter of 4 μm through 10 μm.

FIG. 3 is a table indicating relationships between driving frequencies and average liquid droplet diameters. The average liquid droplet changes according to the driving frequency. As shown in FIG. 3, it was found that a driving frequency of 300 kHz through 1,000 kHz (1 MHz) is optimum.

Generally, the relationship between the liquid droplet diameter d [m] and a frequency f [Hz] satisfies the following formula.

$$d=0.34(8\pi T/\rho f2)1/3$$

(T: surface tension of liquid (in the case of water, 0.0721 N/m at 24° C.), ρ: density of liquid (in the case of water, 1,000 $kg/m^3$))

The results of the present experiment are consistent with the above formula. Incidentally, when on-demand application is performed in the above manner, not all of the liquid droplets 5*a* adhere to the toner. Therefore, even after the recording sheet 1 has passed through the spray chamber 4, there will be many sprayed liquid droplets 5*a* (i.e., toner fixing liquid 5) floating in the spray chamber 4. Hence, the liquid droplets 5*a* may eventually drop onto/adhere to the inner walls of the spray chamber 4 or the part along which the recording sheet 1 passes, thus soiling these portions.

When the sprayer 6 employs the piezo element 32, and the driving frequency is specified to be in a range of 300 kHz through 1 MHz, the diameter of the sprayed liquid droplets 5*a* becomes 4 μm through 10 μm, which is an optimum diameter for floating in midair. Accordingly, the liquid droplets 5*a* are prevented from dropping immediately, thus preventing a situation where a large amount of liquid droplets 5*a* cover the entire recording sheet 1.

The toner is softened when the toner fixing liquid 5 is selectively placed on the recording sheet 1 only on portions with the toner, and then the liquid droplets 5*a* dry or penetrate into the fiber of the recording sheet 1 or into the toner. As a result, the toner is immediately hardened and fixed onto the recording sheet 1. By applying pressure onto the recording sheet 1 immediately after the toner fixing liquid 5 has been applied and the toner has softened, the fixing force is increased and the toner becomes flat. This enhances color reproducibility.

A description is given of a method of collecting the sprayed toner fixing liquid 5 (sprayed liquid 5) continuing to float as the liquid droplets 5*a* in the spray chamber 4, and reusing the collected sprayed liquid 5. FIG. 1 illustrates an exhaust duct 12 for suctioning/exhausting the sprayed liquid 5 floating within the spray chamber 4; the spray chamber 4 is communicated with the atmosphere via the exhaust duct 12.

An exhaust fan 14 creates an air current that forcibly flows out from the spray chamber 4 into the atmosphere, and causes the remaining toner fixing liquid 5 (liquid droplets 5*a*) floating in the spray chamber 4 to adhere to a toner fixing liquid collecting filter 13. The toner fixing liquid 5 is turned into liquid once again, and is induced into the fixing liquid bottle 8 through a tube 33, to be reused. The exhaust fan 14 suctions the air through passageways 34, which passageways 34 are used for the recording sheet 1 to enter/exit the spray chamber 4.

Under regular conditions, when the recording sheets 1 are continuously provided into the spray chamber 4, the spray chamber 4 is filled with the sprayed toner fixing liquid 5. When the recording sheets 1 stop coming into the spray chamber 4, e.g., when the machine is in a standby status, the air inside the spray chamber 4 is exhausted so that the toner fixing liquid 5 inside the spray chamber 4 is collected.

It is necessary to periodically exhaust the air inside the spray chamber 4 without spraying the toner fixing liquid 5 in order to dry the toner fixing liquid 5 that has adhered to the inner walls of the spray chamber 4 or the liquid droplets 5*a* that have turned into liquid. This prevents the toner fixing liquid 5 adhering to the inner walls of the spray chamber 4 from adhering to the recording sheet 1.

The reference numeral 15 in FIG. 1 denotes a pressurizing roller. The recording sheet 1 receives pressure by being sandwiched between the pressurizing roller 15 and an opposite roller 16. When the toner fixing liquid 5 adheres to the toner on the recording sheet 1, the toner is softened by the function of the toner fixing liquid 5. By receiving pressure, the toner is pressed inside the paper fiber of the recording sheet 1 so that it is anchored and firmly fixed to the recording sheet 1.

In a fixing device using the toner fixing liquid 5, it is imperative that a so-called on-demand application method is employed to reduce the amount of fixing liquid consumed and to prevent the recording sheet 1 from curling or cockling. With the on-demand application method, the liquid droplets 5*a* of the toner fixing liquid 5 only adhere to portions with toner.

Figure 4:
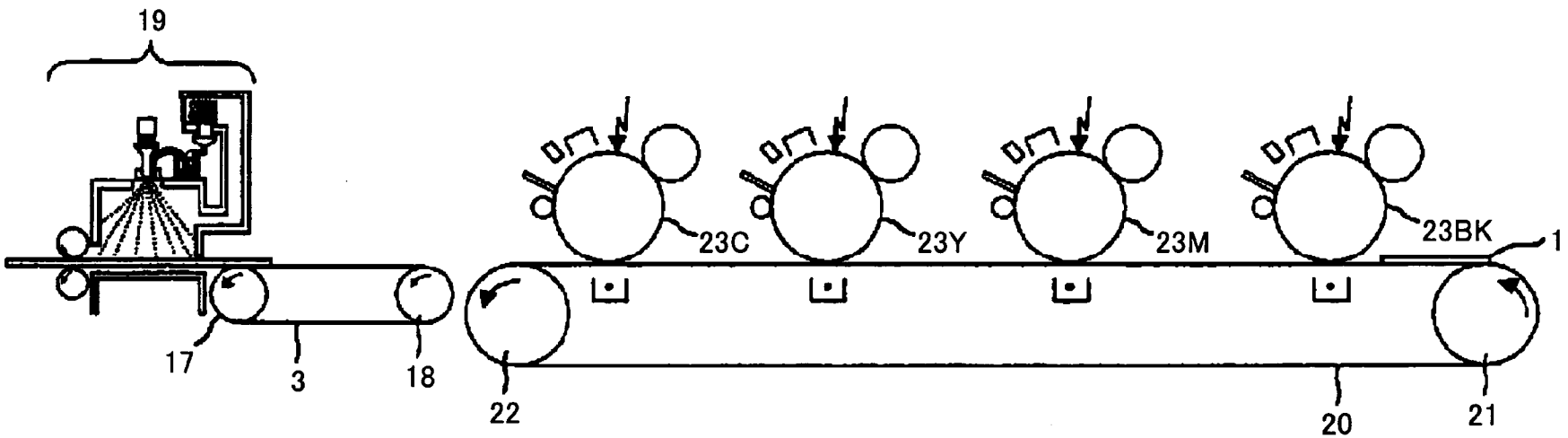
FIG. 4 is a schematic diagram of an image recording apparatus employing the fixing device according to an embodiment of the present invention.
Figure 5:
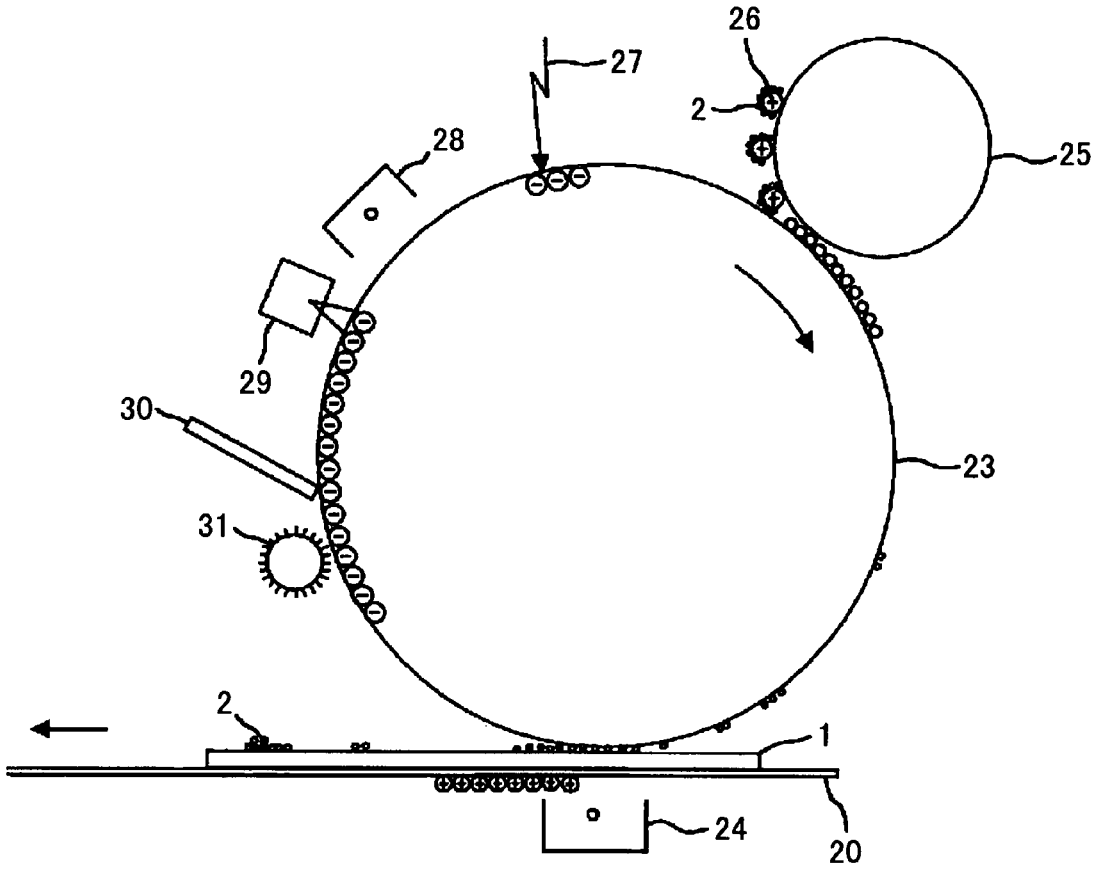
FIG. 5 is a schematic diagram illustrating the portions around an image carrier shown in FIG. 4.

FIG. 4 is a schematic diagram of an image recording apparatus (image forming apparatus) employing the fixing device according to an embodiment of the present invention. FIG. 5 is a schematic diagram illustrating the portions around each of the image carriers shown in FIG. 4. In the following, a description is given of an image recording apparatus to which the fixing device according to an embodiment of the present invention is applied.

Referring to FIGS. 4 and 5, an image forming unit includes image carriers 23 corresponding to black (23Bk), magenta (23M), yellow (23Y), and cyan (23C), arranged in the stated order in the conveyance direction. Underneath the image carriers 23, there is provided a conveying belt 20 wound around a roller 21 and a roller 22.

The recording sheet 1 is conveyed from the right to the left as viewed in FIG. 4 so that toner is transferred from the image carriers 23 in the order of black, magenta, yellow, and cyan. Images of these colors are superposed on each other to form a full-color image. After toner of these four colors is placed on the recording sheet 1, the recording sheet 1 is conveyed to a fixing device 19 according to an embodiment of the present invention by the conveying belt 3 wound around the roller 17 and the roller 18.

As described above, the toner fixing liquid 5 is applied to the unfixed toner 2 on the recording sheet 1 in accordance with image data so that the toner is dissolved and then fixed. Next, as shown in FIG. 5, toner remaining on the image carriers 23 is scraped off by a cleaning brush 31 and a cleaning blade 30.

Next, electric charges on each of the image carriers 23 are removed by a charge eliminating lamp 29. The image carrier 23 is uniformly negatively charged by a charger 28, and is then exposed (as indicated by an arrow 27) so that a latent image is created on the image carrier 23. A developing sleeve 25 transfers the unfixed toner 2, which is carried on positively charged carriers 26, to the image carrier 23. A positive transfer charger 24 performs a secondary transfer, causing the unfixed toner 2 to be transferred onto the recording sheet 1 to form an unfixed image.

At this point, the unfixed toner is negatively charged. Accordingly, the positively charged liquid droplets 5*a* selectively adhere to the unfixed toner due to a Coulomb force. As a matter of course, if the charging electrodes of the electrophotographic process are opposite to those of the above description, the unfixed toner charges will be positive. In this case, negative charges need to be applied to the liquid droplets 5*a*.

Subsequently, in conventional copiers and printers, the recording sheet 1 enters a fixing device using heat at the final stage. However, the heat method consumes a large amount of power. Furthermore, even while the copier is not being used, the heater needs to be maintained at a considerably high temperature to reduce the time required for starting up. Thus, the copier consumes a considerable amount of power when it is operating, even in a standby status.

Conversely, in the fixing method using the fixing liquid according to an embodiment of the present invention, a fixing unit consumes low power during operation, and consumes substantially no power in a standby status.

Figure 6:
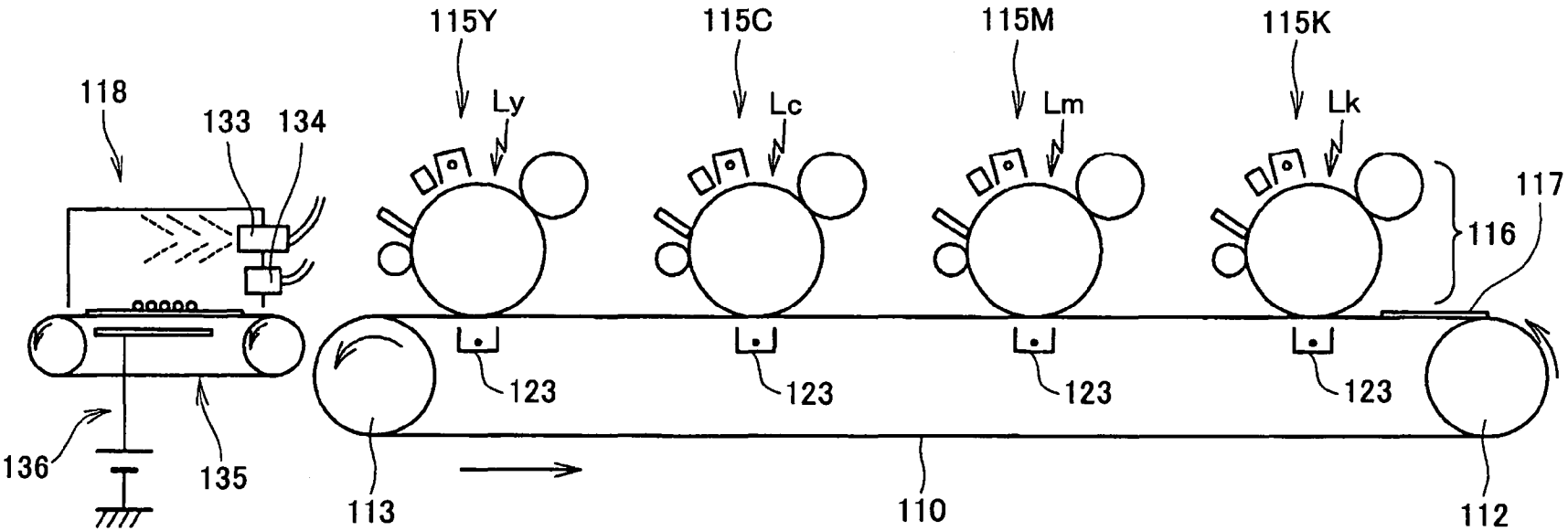
FIG. 6 illustrates relevant parts of an image forming apparatus.

FIG. 6 illustrates relevant parts of an image forming apparatus such as a copier, a printer, a facsimile machine, or a multifunction peripheral including these functions. FIG. 6 illustrates an electrophotographic tandem-type color image forming apparatus employing a direct transfer method in which a toner image on an image carrier is directly transferred onto a sheet acting as a recording material, without using an intermediate transfer body.

In FIG. 6, the reference numeral 110 denotes an endless belt-type conveying belt. The conveying belt 110 is wound around a driving roller 112 and a following roller 113 and is rotatable in a counterclockwise direction. As a matter of course, the conveying belt 110 can be wound around more than two rollers. For example, the conveying belt 110 can be wound around three or more rollers including a roller for adjusting deviation of the conveying belt 110 or a tension roller.

Above the horizontal portion of the conveying belt 110 stretched between the driving roller 112 and the following roller 113, there are provided four image creating units 115K, 115M, 115C, and 115Y, respectively corresponding to black, magenta, cyan, and yellow, which are arranged horizontally in the stated order in the moving direction of the conveying belt 110. These image creating units are included in a tandem image creating device 116. Although not shown, elements such as an exposing device are provided above the tandem image creating device 116.

Between the conveying belt 110 and the tandem image creating device 116, there is formed a sheet conveying path for conveying a sheet 117 from the right side to the left side as viewed in FIG. 6 as the conveying belt 110 rotates in the counterclockwise direction. Along the sheet conveying path, a not shown registration roller is arranged on the upstream side and a fixing device 118 is arranged on the downstream side.

Figure 7:
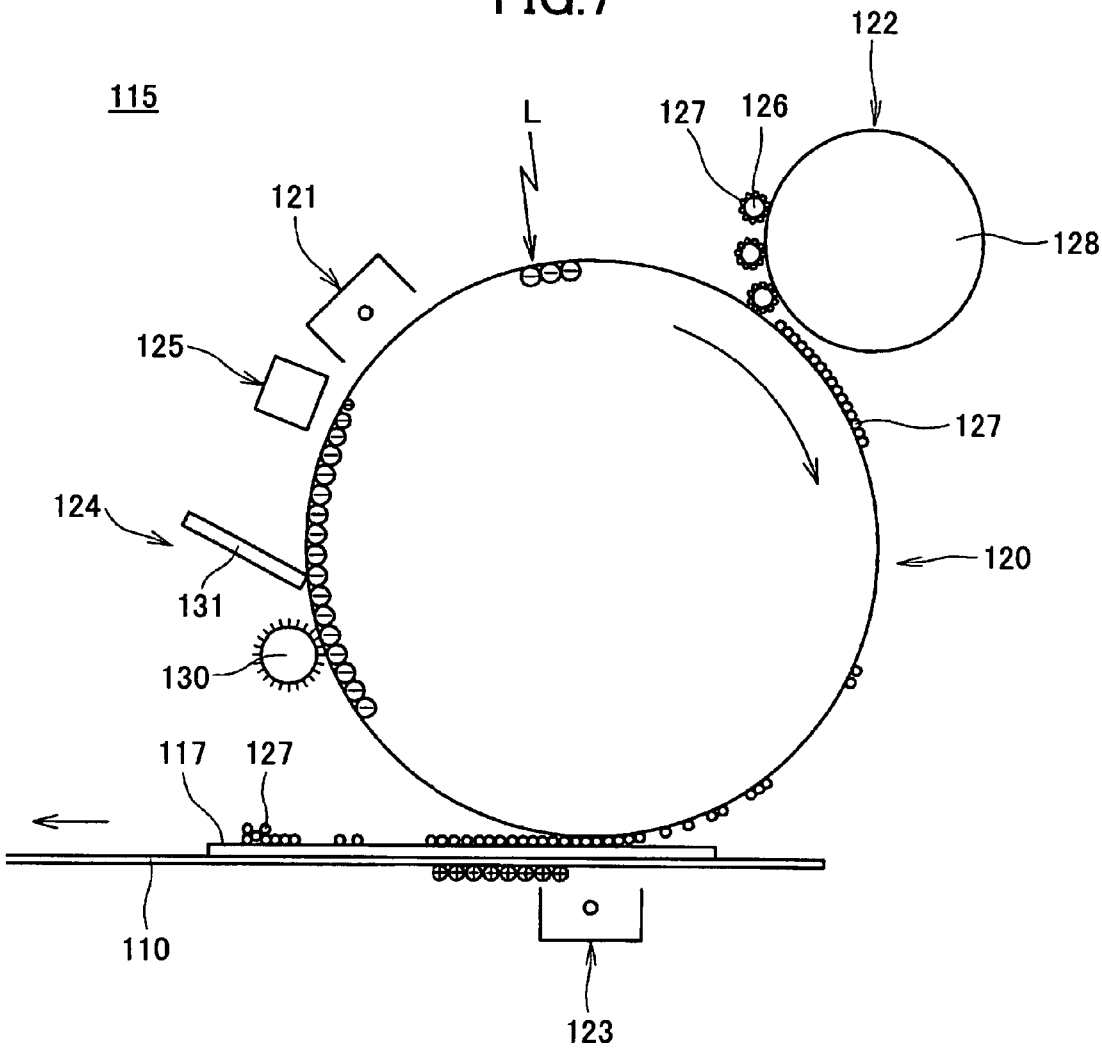
FIG. 7 is an enlarged schematic view of one of the image creating units included in the image forming apparatus shown in FIG. 6.

FIG. 7 is a schematic diagram of one of the image creating units 115 included in the image forming apparatus shown in FIG. 6.

The four image creating units 115K, 115M, 115C, and 115Y have the same configuration as illustrated in FIG. 7.

The reference numeral 120 denotes a photoconductor acting as a drum-type image carrier. Starting with a charging device 121 positioned at the top left side, a developing device 122, a transfer device 123, a cleaning device 124, and a charge eliminator 125 are arranged around the photoconductor 120 in the stated order in the rotational direction indicated by an arrow.

The charging device 121 employs a non-contact charging method to uniformly negatively charge the photoconductor 120 with the use of a charger. However, a contact-type charging method using a charging roller can be employed. The developing device 122 uses a two-component developer including positively charged carriers 126 and negatively charged toner 127. The two-component developer is carried by a developing sleeve 128, and only the toner 127 is caused to adhere to the photoconductor 120 in order to make an electrostatic latent image on the photoconductor 120 become visible.

The transfer device 123 employs a non-contact positive transfer corona charging method, and is arranged to face the photoconductor 120 with the conveying belt 110 therebetween. Instead of the non-contact corona charging method, a conductive brush or a transfer roller can be employed. The cleaning device 124 includes a cleaning brush 130 and a cleaning blade 131 as cleaning members. Accordingly, the toner scraped off by the cleaning brush 130 and the cleaning blade 131 is collected by a not shown collecting screw or a toner recycling device, returned to the developing device 122, and is reused. The charge eliminator 125 is, for example, a charge eliminating lamp.

As the photoconductor 120 rotates in a clockwise direction, the surface of the photoconductor 120 is uniformly charged by the charging device 121, the not shown exposing device irradiates a writing light beam L (Lk, Lm, Lc, and Ly in FIG. 6), so that an electrostatic latent image is formed on each photoconductor 120. Subsequently, the developing device 122 causes toner of the corresponding color to adhere to the electrostatic latent image so that the electrostatic latent image is made visible. Accordingly, a monochrome toner image of a corresponding color is formed on each photoconductor 120.

The sheet 117 is conveyed through the sheet conveying path. First, the sheet 117 is sent onto the conveying belt 110 by registration rollers at a timing in consideration of the toner images formed on the photoconductors 120. As the conveying belt 110 rotates, the sheet 117 is further conveyed so that monochrome toner images on the photoconductors 120 are sequentially transferred onto the sheet 117 by their respective transfer devices 123. The monochrome toner images are superposed on the sheet 117, thus forming a composite color image. After the toner images have been transferred from the photoconductors 120, the surface of each photoconductor 120 is cleaned with the cleaning device 124 and electric charges are eliminated with the charge eliminator 125, so that the photoconductor 120 is initialized to be prepared for another image forming operation, which is started at the charging device 121.

The negatively charged toner 127 forming the composite color image on the sheet 117 is electrically adhering to the sheet 117 at this point. Therefore, if the toner 127 receives a strong shock or if the toner 127 is scraped, the toner 127 will come off the sheet 117. For this reason, the sheet 117 with the composite color image is conveyed to the fixing device 118 by the conveying belt 110, and the transferred image is fixed by the fixing device 118 before the sheet 117 is ejected to a not-shown ejected-sheet stacking unit.

As shown in FIG. 6, the fixing device 118 includes a spraying unit 133 for spraying toner fixing liquid as fixing liquid droplets, a liquid droplet charging unit 134 for applying a negative charge to the fixing liquid droplets sprayed by the spraying unit 133, which negative charge has the same polarity as the unfixed toner, a medium conveying unit 135 for conveying the sheet 117 on which unfixed toner is placed through an atmosphere with fixing liquid droplets charged by the liquid droplet charging unit 134, and a recording material charging unit 136 for applying a positive charge to the sheet 117 being conveyed by the medium conveying unit 135, which positive charge has a polarity opposite to that of the unfixed toner and the fixing liquid droplets.

Figure 8:
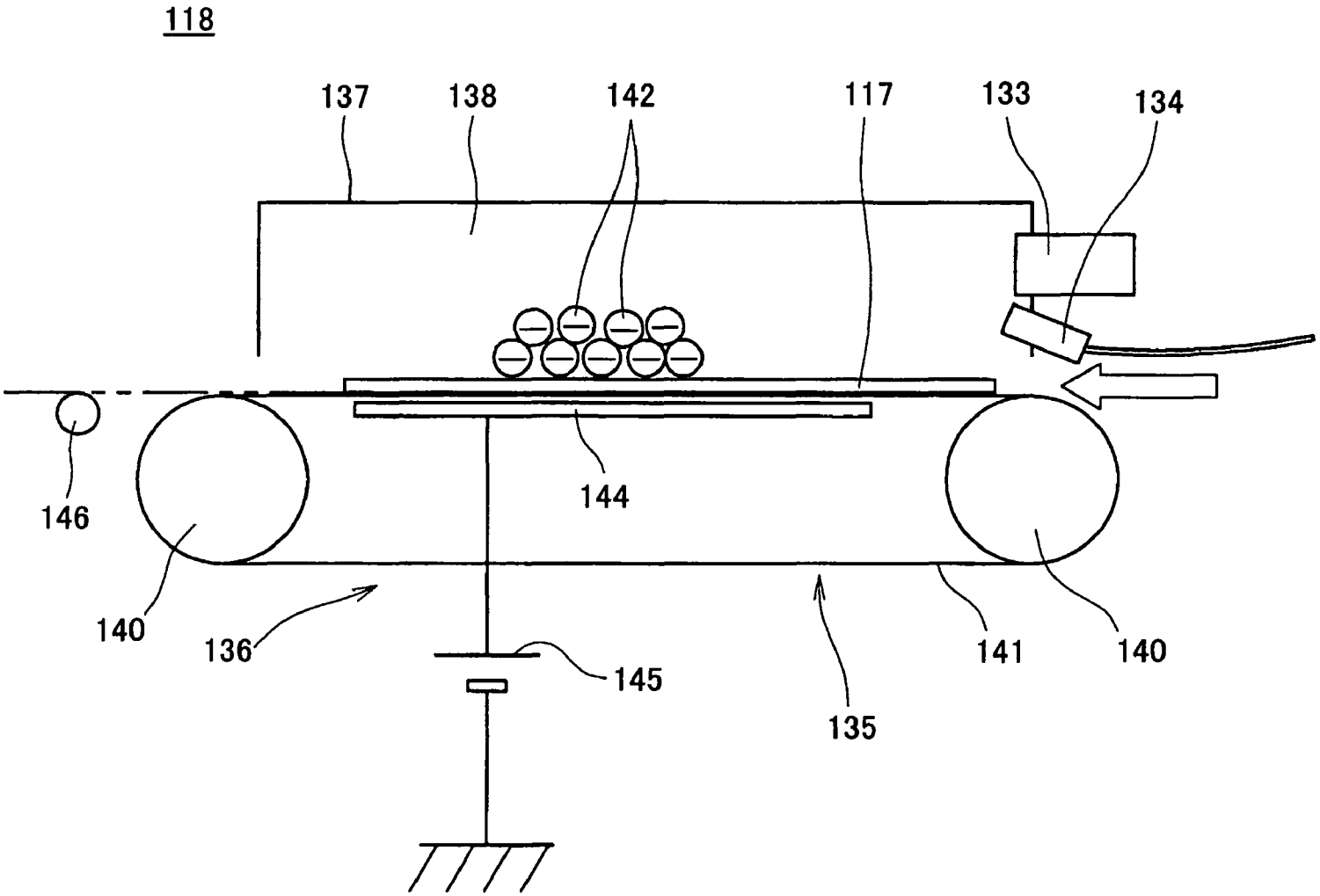
FIG. 8 is an enlarged view of a fixing device included in the image forming apparatus shown in FIG. 6.

FIG. 8 is an enlarged view of the fixing device 118 shown in FIG. 6.

As shown in FIG. 8, the spraying unit 133 is arranged in such a manner as to face the inside of a spraying chamber 138 partitioned by a casing 137. The toner fixing liquid stored in a not shown fixing liquid storing unit is sprayed as fixing liquid droplets with diameters having a mode value of 15 μm or less. Accordingly, the spraying chamber 138 becomes filled with fixing liquid droplets.

The toner fixing liquid includes a softening agent that softens the toner by dissolving or half-dissolving the toner and a solvent that disperses or dissolves the softening agent. In consideration of usability and safety, the toner fixing liquid is preferably odorless and harmless to the human body. Accordingly, a preferable example of the softening agent is fatty ester, more specifically, linear saturated fatty ester, aliphatic dibasic acid ester, or aliphatic dibasic acid dialkoxy dialkyl ester. A preferable example of the solvent is water, in that water is environmentally sound, low-cost, odorless, harmless, safe, and has a high degree of usability. A surface-active agent can be added to the fixing liquid for the purpose of controlling the wettability of the fixing liquid onto unfixed toner, which fixing liquid contains a softening agent of a predetermined density, and controlling the speed of permeating the sheet 117.

An ionizer is used as the liquid droplet charging unit 134, to spray air ions into the spraying chamber 138. The air ions are mixed together with the fixing liquid droplets sprayed by the spraying unit 133, so that the fixing liquid droplets are negatively charged to have the same polarity as that of the unfixed toner. In a different example from that in FIG. 8, if the unfixed toner is positively charged, the fixing liquid droplets will be positively charged.

The medium conveying unit 135 includes plural rollers 140 and a conveying belt 141 wound around the rollers 140. The conveying belt 141 conveys the sheet 117 while the sheet 117 is electrostatically adhering to the conveying belt 141. Unfixed toner 142 that has negative residual charges as shown in FIG. 8 is transferred to the sheet 117 at the transfer device 123. The sheet 117 on which the unfixed toner 142 is placed is conveyed by the conveying belt 110 and sent to the fixing device 118. The sheet 117 continues to be conveyed by the conveying belt 141 of the medium conveying unit 135 of the fixing device 118 from the right to the left as viewed in FIG. 8, through the atmosphere including fixing liquid droplets charged by the liquid droplet charging unit 134.

The recording material charging unit 136 includes an electrode 144 arranged on the inside of the conveying belt 141 wound around the rollers 140 and a power source 145 connected to the electrode 144. The power source 145 applies a voltage to the electrode 144 arranged on the inside of the conveying belt 141. Accordingly, the sheet 117 conveyed by the conveying belt 141 is positively charged, to have a polarity opposite to those of the unfixed toner 142 and the fixing liquid droplets. The conveying belt 141 is made of a material that does not prevent the sheet 117 from being charged. Thus, by being suctioned (attracted) by a Coulomb force exerted from behind the sheet 117, the fixing liquid droplets adhering to the sheet 117 permeate further through the sheet 117 until they reach the back side of the sheet 117. Accordingly, the density of the fixing liquid is made equal on the front side and the back side of the sheet 117, thereby mitigating a curling phenomenon of the sheet 117.

The reference numeral 146 in FIG. 8 denotes a charge eliminating roller acting as a charge eliminating member for contacting the sheet 117 and eliminating electric charges from the sheet 117, which sheet 117 has come out of the fixing device 118. The charge eliminating member is not limited to a roller, but can be a brush, etc.

As described above, in the example shown in FIGS. 6 through 8, the liquid droplet charging unit 134 charges the fixing liquid droplets sprayed by the spraying unit 133 to make them have the same polarity as that of the unfixed toner 142 on the sheet 117. The medium conveying unit 135 conveys the sheet 117 on which the unfixed toner 142 is placed through the atmosphere including the charged fixing liquid droplets. The recording material charging unit 136 charges the conveyed sheet 117 to make it have a polarity opposite to those of the unfixed toner 142 and the fixing liquid droplets. As described below with reference to FIG. 12B, by being forcibly attracted by a Coulomb force, the unfixed toner 142 and fixing liquid droplets 153 adhere to the sheet 117. The unfixed toner 142 is softened by the softening agent in the fixing liquid and is fixed to the sheet 117.

Accordingly, the unfixed toner 142 on the sheet 117 is electrostatically attracted toward the sheet 117 that is charged to an opposite polarity. Therefore, the unfixed toner 142 on the sheet 117 is prevented from scattering so that the toner image does not become distorted, and a fixing operation can be performed in a favorable manner without decreasing image quality. Furthermore, the fixing liquid droplets 153 are electrostatically attracted to the sheet 117 that is charged to an opposite polarity. Hence, the fixing liquid droplets 153 uniformly adhere to the sheet 117 without being wasted and without causing fixing irregularities, and the fixing liquid is used effectively so that consumption of the fixing liquid is reduced. Moreover, the fixing liquid droplets 153 adhering to the sheet 117 are further electrostatically attracted so that they reach the backside of the sheet 117. Hence, the density of the fixing liquid is made equal on the front side and the back side of the sheet 117, thereby mitigating a curling phenomenon of the sheet 117.

When the toner fixing liquid is sprayed by the spraying unit 133 as the fixing liquid droplets 153 with diameters having a mode value of 15 μm or less, the sprayed fixing liquid droplets 153 uniformly float in midair as dry mist, and adhere to the sheet 117 without being wasted and without irregularities. Accordingly, the fixing liquid droplets 153 adhere to the sheet 117 without being wasted so that the fixing liquid can be used effectively and fixing irregularities can be eliminated.

Figure 9A:
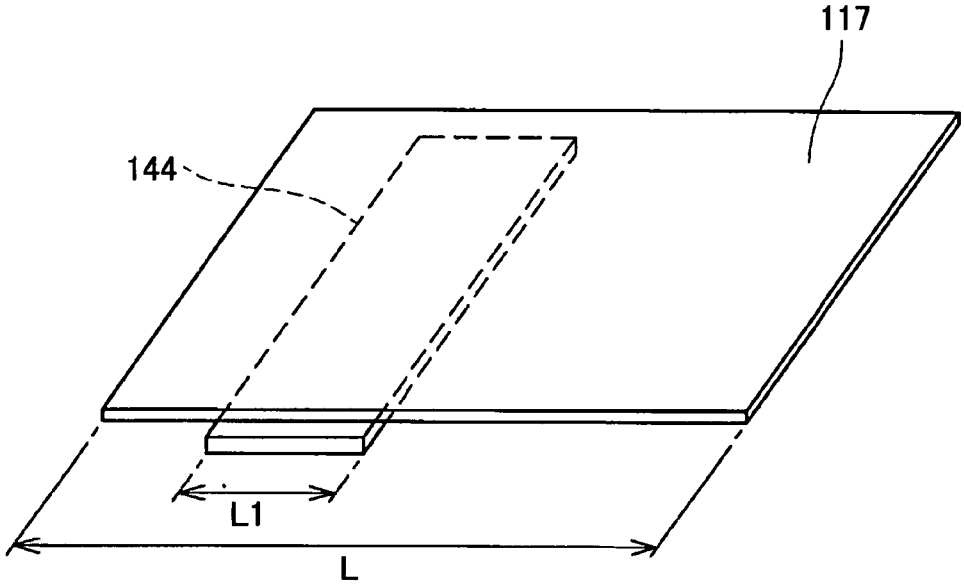
FIGS. 9A and 9B are perspective views illustrating the size of an electrode compared to the size of a sheet.
Figure 9B:
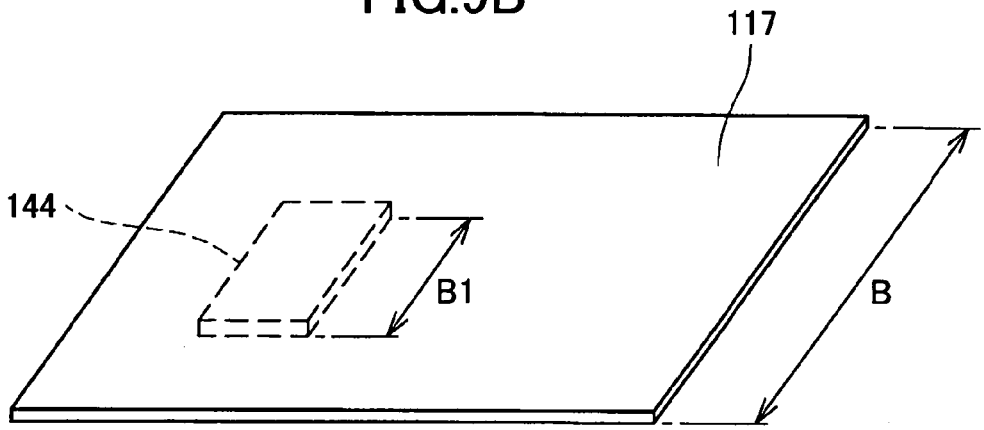

FIGS. 9A and 9B illustrate the size of the electrode 144 compared to the size of the sheet 117.

As shown in FIG. 9A, the length L1 of the electrode 144 can be less than the length L of the sheet 117. As shown in FIG. 9B, the width B1 of the electrode 144 can be less than the width B of the sheet 117. Experimental results show that the electrode 144 having a shorter length and a shorter width than those of the sheet 117 is capable of charging the entire sheet 117.

Figure 10:
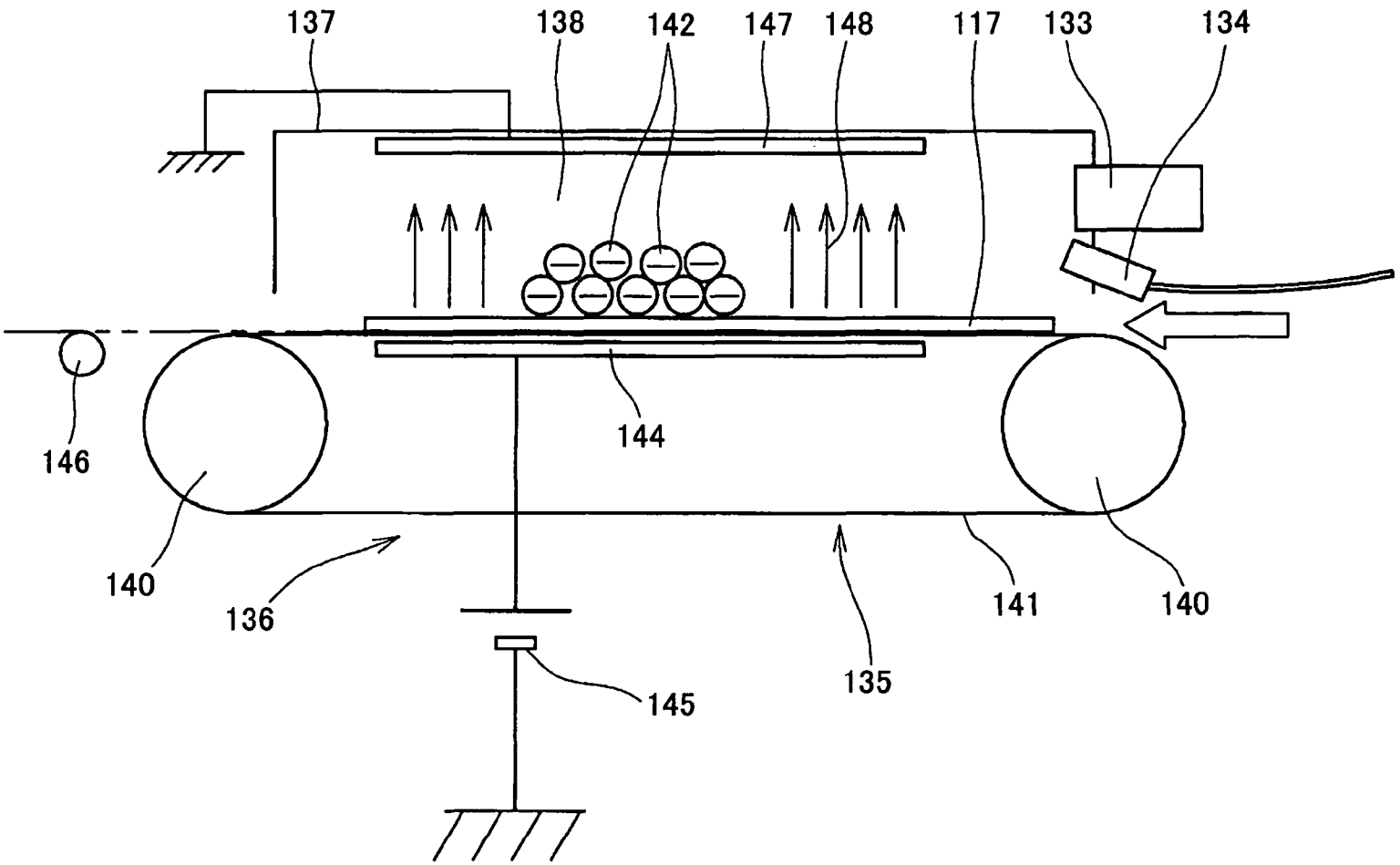
FIG. 10 is an enlarged schematic diagram of a variation of the fixing device.

FIG. 10 illustrates a variation of the fixing device 118.

In this example, an opposite electrode 147 is arranged inside the spraying chamber 138, in such a manner as to face the electrode 144. Accordingly, an electric field 148 is formed inside the spraying chamber 138, further intensifying the force by which the unfixed toner 142 and the fixing liquid droplets 153 are attracted to the sheet 117. In FIG. 10, the other elements have the same reference numerals as those of FIG. 8.

Figure 11:
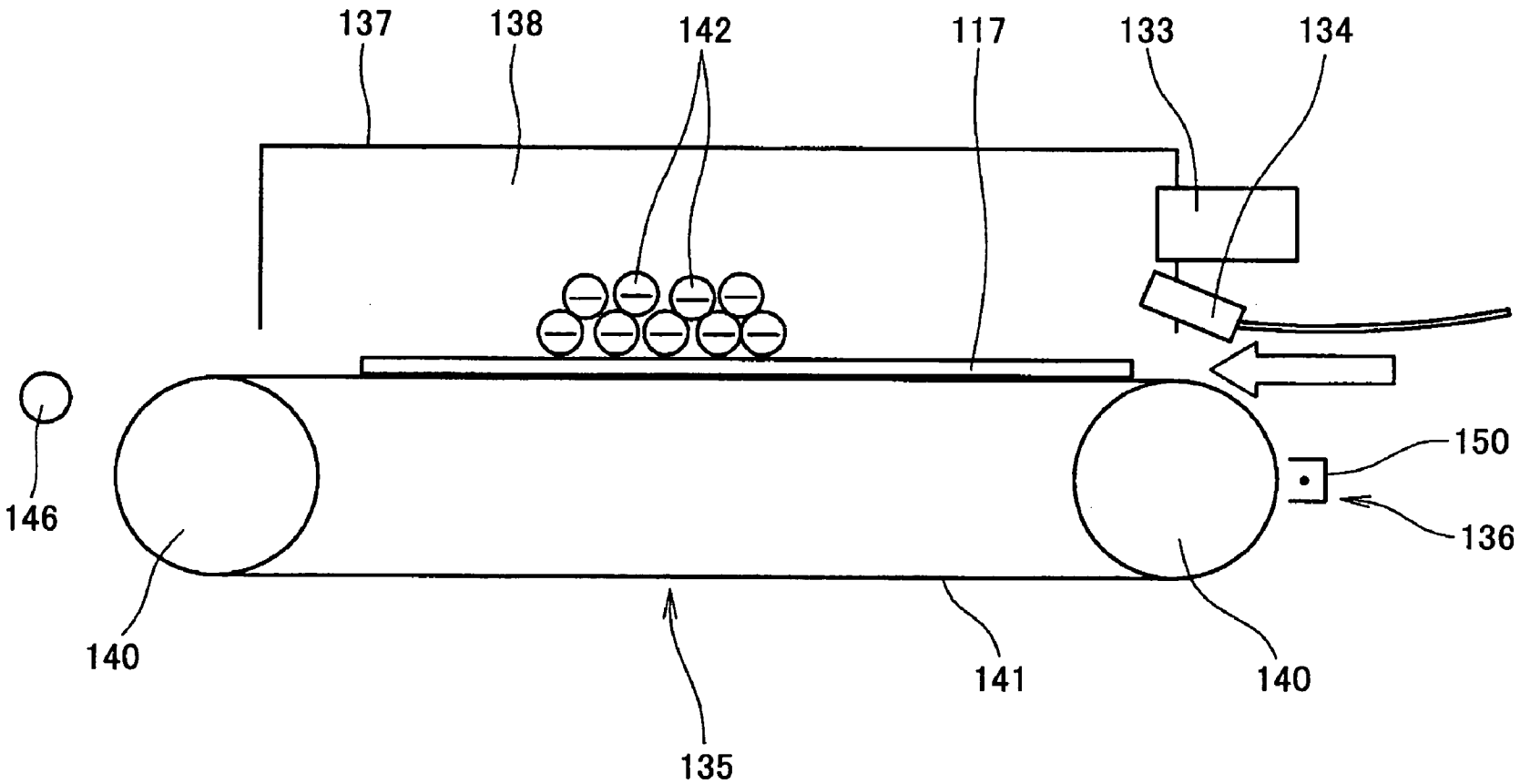
FIG. 11 is an enlarged schematic diagram of another example of the fixing device.

FIG. 11 illustrates another example of the fixing device 118.

In this example, the recording material charging unit 136 includes the conveying belt 141 wound around the rollers 140 and an application unit 150 including a charger for charging the conveying belt 141 so that the sheet 117 is charged to a polarity opposite to those of the unfixed toner 142 and the fixing liquid droplets 153. The application unit 150 charges the conveying belt 141, and as a result, the sheet 117 being conveyed by the conveying belt 141 is charged to a polarity opposite to those of the unfixed toner 142 and the fixing liquid droplets 153. Consequently, the unfixed toner 142 and the fixing liquid droplets 153 are reliably electrostatically attracted to the sheet 117 charged to an opposite polarity. Also in FIG. 11, the other elements have the same reference numerals as those of FIG. 8.

Figure 12A:
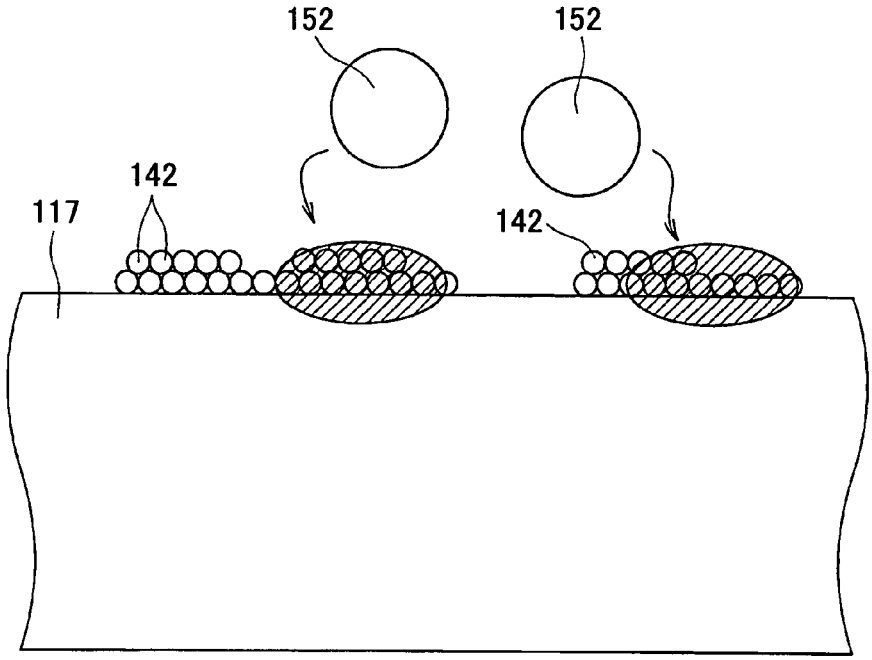
FIG. 12A illustrates how relatively large fixing liquid droplets adhere to unfixed toner on a sheet and FIG. 12B illustrates how relatively small fixing liquid droplets adhere to unfixed toner on a sheet according to an embodiment of the present invention.
Figure 12B:
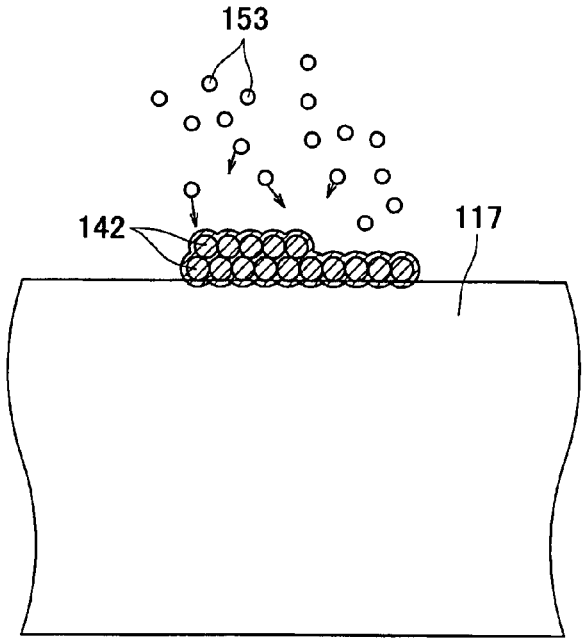

FIGS. 12A and 12B illustrate how fixing liquid droplets 152, 153 adhere to the sheet 117. In FIG. 12A, relatively large fixing liquid droplets 152, specifically, with diameters having a mode value of 40 μm through 80 μm, adhere to the unfixed toner 142 on the sheet 117. If the droplets are as large as this, the fixing liquid droplets 152 will drop due to their own weight. Furthermore, even if the droplets are floating in a horizontal or upward direction, they will directly strike the sheet 117 by applying an initial velocity. Meanwhile, FIG. 12B illustrates relatively small fixing liquid droplets 153, specifically, with diameters less than or equal to 15 μm, adhering to the unfixed toner 142 on the sheet 117.

In a fixing method employing a fixing liquid, a small amount of fixing liquid is preferably applied onto the sheet 117 in order to prevent curls or stickiness, and also in consideration of the capacity of a fixing liquid tank in the fixing liquid storing unit. For example, when applying the fixing liquid to an A4-sized sheet 117 (210 mm×297 mm), the amount of liquid applied is to be 0.2 g/A4-sized sheet at maximum, preferably less than or equal to 0.1 g/A4-sized sheet, and desirably 0.05 g/A4-sized sheet. There may be variations in the fixability depending on the composition of the fixing liquid. However, no matter what the composition is, the commercial value of the sheet 117 after the fixing operation will decrease unless the fixing liquid is applied in the above-described amounts.

Figure 13:
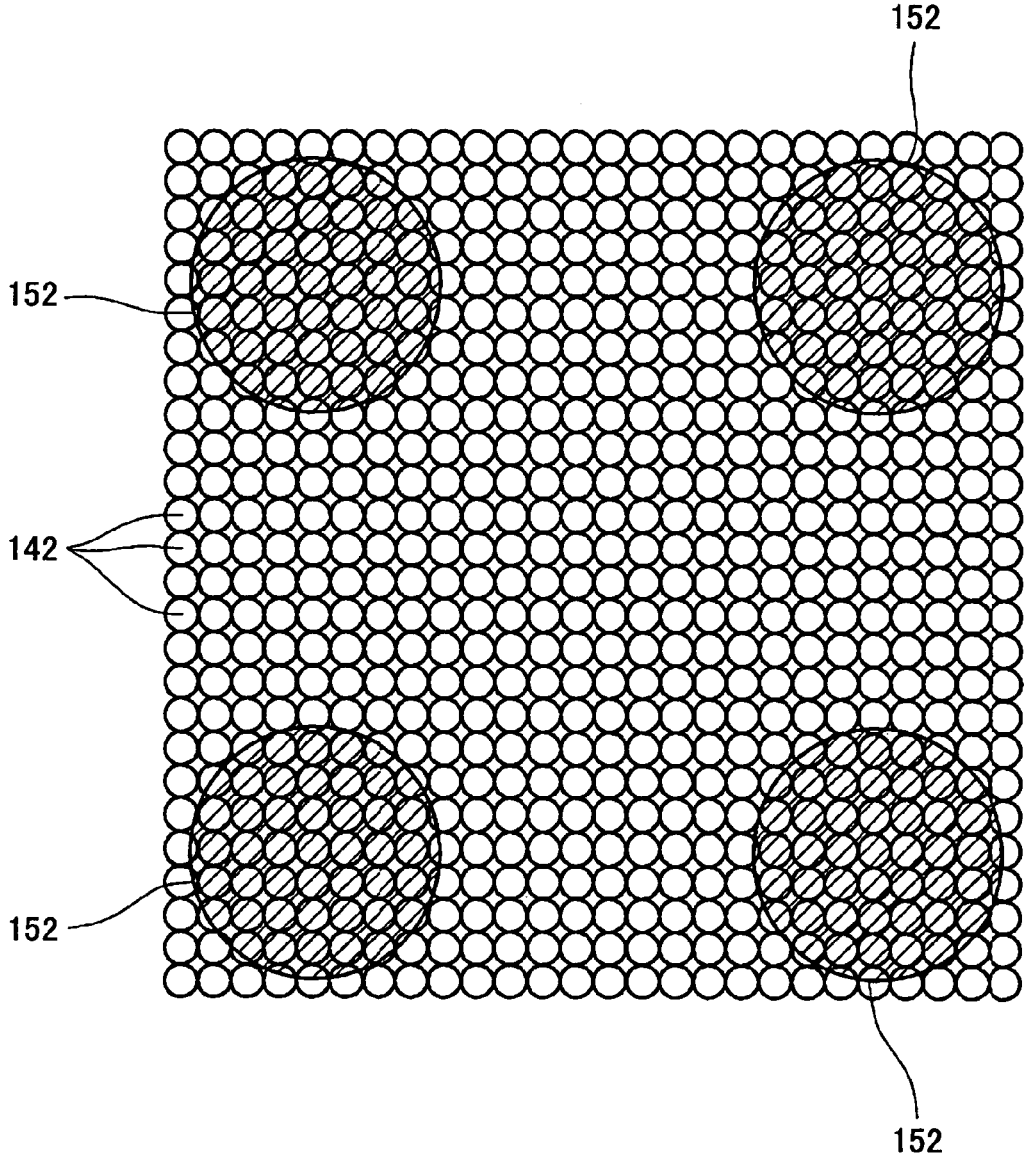
FIG. 13 is a plan view of a recording material of the case illustrated in FIG. 12A.

It is assumed that the required amount of fixing liquid to be applied is 0.1 g/A4-sized sheet and the diameter of the fixing liquid droplets 152 is 60 μm. The volume of each 60 μm droplet will be 113,040 $\mu m^3$, and therefore, assuming that the relative density is one, the weight of each droplet will be $1.13\times10^{-7}$ g. This means that, in order to apply 0.1 g of fixing liquid, 884,643 drops of fixing liquid droplets 152 are required. Assuming that 884,643 drops of fixing liquid droplets 152 are evenly arranged on the A4-sized sheet 117, the intervals between droplets can be calculated as 265 μm. If a droplet strikes the sheet under regular conditions, its diameter will increase, becoming 1.5 through 2.5 times the original diameter. Even in consideration of this increase in size, the entire sheet 117 cannot be entirely covered, resulting in application irregularities as shown in FIG. 13, which lead to fixing irregularities. When liquid droplets having a diameter d strike the sheet 117, the total area covered by fixing liquid needs to be at least equal to the area of the sheet 117 that needs to be covered by the fixing liquid.

Figure 14:
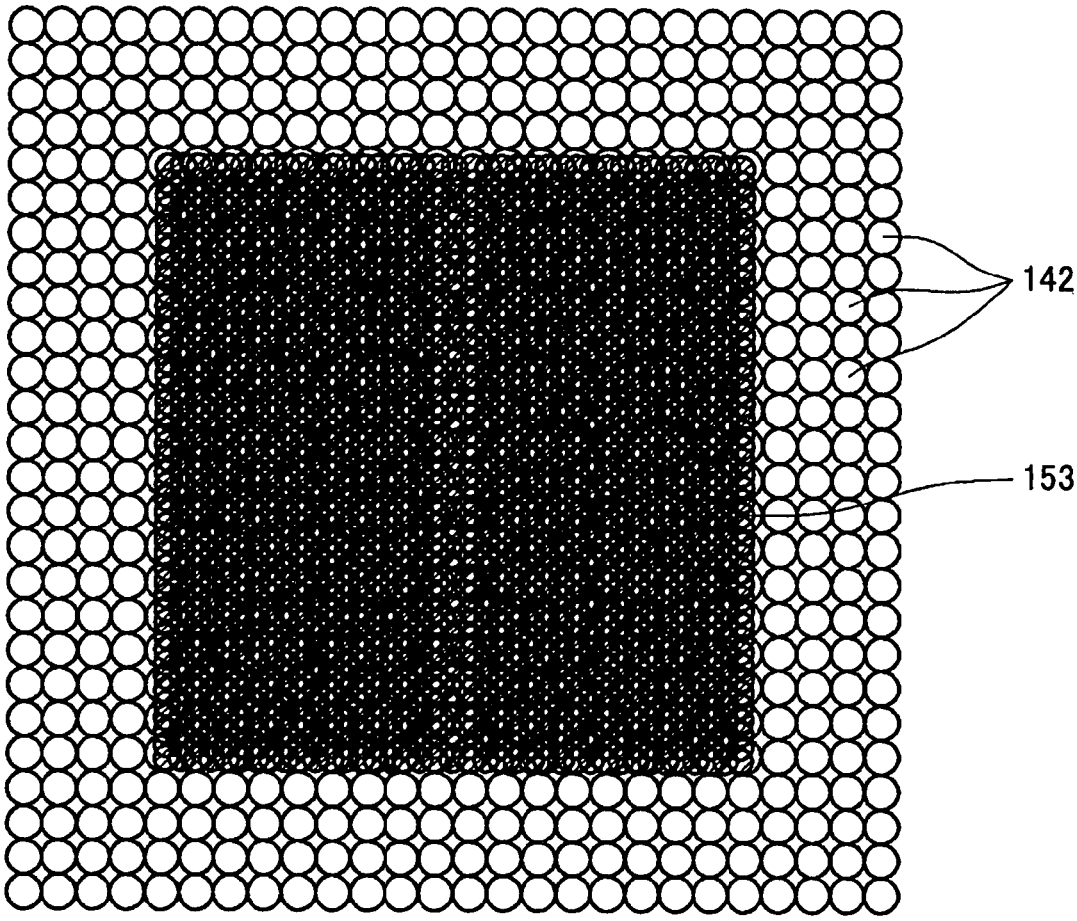
FIG. 14 is a plan view of a recording material of the case illustrated in FIG. 12B.

FIG. 12B illustrates the fixing liquid droplets 153 that are smaller than the fixing liquid droplets 152, with the diameter of each fixing liquid droplet 153 being, for example, 8 μm. Therefore, the fixing liquid droplets 153 do not permeate into the depth direction of the sheet 117 more than necessary. Accordingly, a thin layer of fixing liquid can be uniformly applied. FIG. 14 illustrates a status where the fixing liquid droplets 153 are applied. Although the same amount as that in FIG. 13 is applied, the area of application is considerably larger. The necessary number of liquid droplets N can be calculated from the droplet diameter d and the sheet area. If the droplet diameter d and the necessary number of liquid droplets N are determined, the amount of liquid application can be calculated. That is, in order to apply the fixing liquid to a certain area without any irregularities, the appropriate liquid droplet diameter will be automatically determined if the amount of application is determined.

A calculation example is given below. It is assumed that the fixing liquid droplet diameter is d [μm], the area on the sheet 117 that needs to be covered by the fixing liquid is S [$cm^2$], the application amount of the fixing liquid onto the sheet 117 is Q [g], the number of liquid droplets is N [drops], and the extent to which the diameter of each droplet increases after striking the sheet 117 is assumed to be minimum, i.e., zero.

Area of each droplet after striking the sheet 117

$$\pi\cdot(d\times10^{-4}/2)^2[cm^2]$$

Volume of each droplet $$(4\pi/3)\cdot(d\times10^{-4}/2)^3[cm^3]$$

As described above, the area to be covered by droplets needs to be at least equal to the area on the sheet 117 that needs to be covered by the fixing liquid is S. Accordingly, the following formula is obtained.

$$N\cdot\pi\cdot(d\times10^{-4}/2)^2=S \quad (1)$$

Furthermore, the following formula is obtained from the total volume of the droplets, where 1 $cm^3$=1 g, and assuming that the relative density is one.

$$N\cdot(4\pi/3)\cdot(d\times10^{-4}/2)^3=Q \quad (2)$$

By modifying each of the above formulae (1) and (2) into a formula starting with N=, and assuming that both are equal, the following formula can be obtained.

$$N=(4S/d^2\times10^{-8})=(6Q/d^3\times10^{-12})$$

This can be modified to the following formula.

$$d=30{,}000\cdot(Q/S) \quad (3)$$

Assuming that the area that needs to be covered by the fixing liquid S is equal to an A4-sized sheet, it is 21 cm×29.7 cm=623.7 $cm^2$. Assuming that the application amount Q is 0.1 g/A4-sized sheet, the diameter can be obtained from the above formula. Consequently, the appropriate diameter is d=4.8 μm. If the diameter of each liquid droplet is larger than this, application irregularities will be caused.

Figure 15:
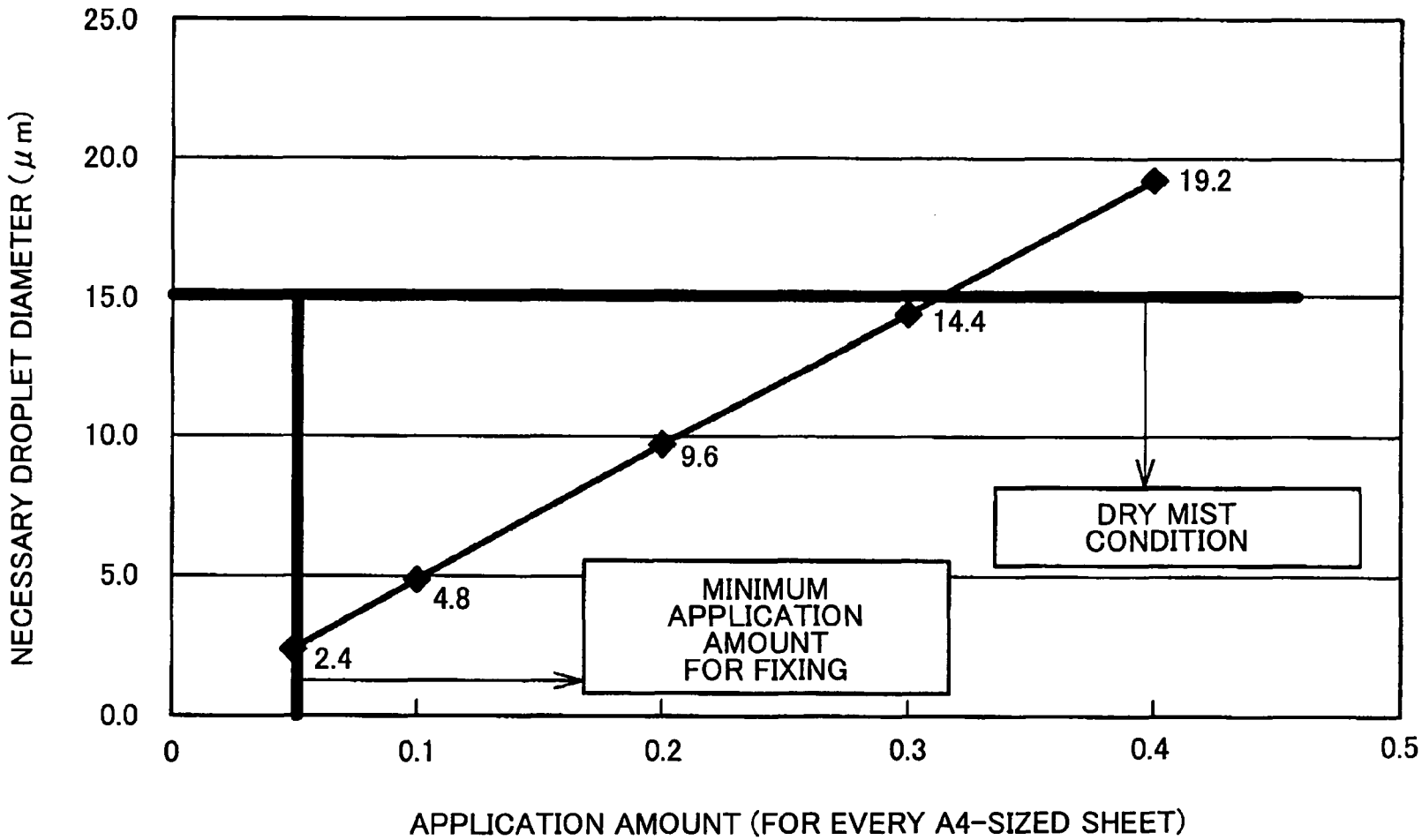
FIG. 15 is a graph indicating the necessary droplet diameter of the fixing liquid droplets in association with the application amount of the fixing liquid.

The present method is realized on condition that the sprayed mist uniformly floats inside the casing 137. Thus, the mist needs to be a so-called dry mist, in which the droplets do not become wet. Otherwise, the sprayed droplets would drop down and cause lower portions of the spraying chamber 138 to become wet, starting from portions close the area onto which the droplets drop down. As a result, the fixing liquid cannot be uniformly applied to the sheet 117. In order to form a dry mist, each droplet diameter needs to be 15 μm or less. FIG. 15 is a graph indicating the necessary droplet diameter according to the formula (3) and the condition for forming a dry mist in association with the application amount, starting from an application amount of 0.05 g/A4-sized sheet, which was found to be the minimum application amount according to experiments conducted by inventors of the present invention. As a matter of course, the minimum required liquid amount 0.05 g/A4-sized sheet would vary depending on the composition of the fixing liquid.

Figure 16:
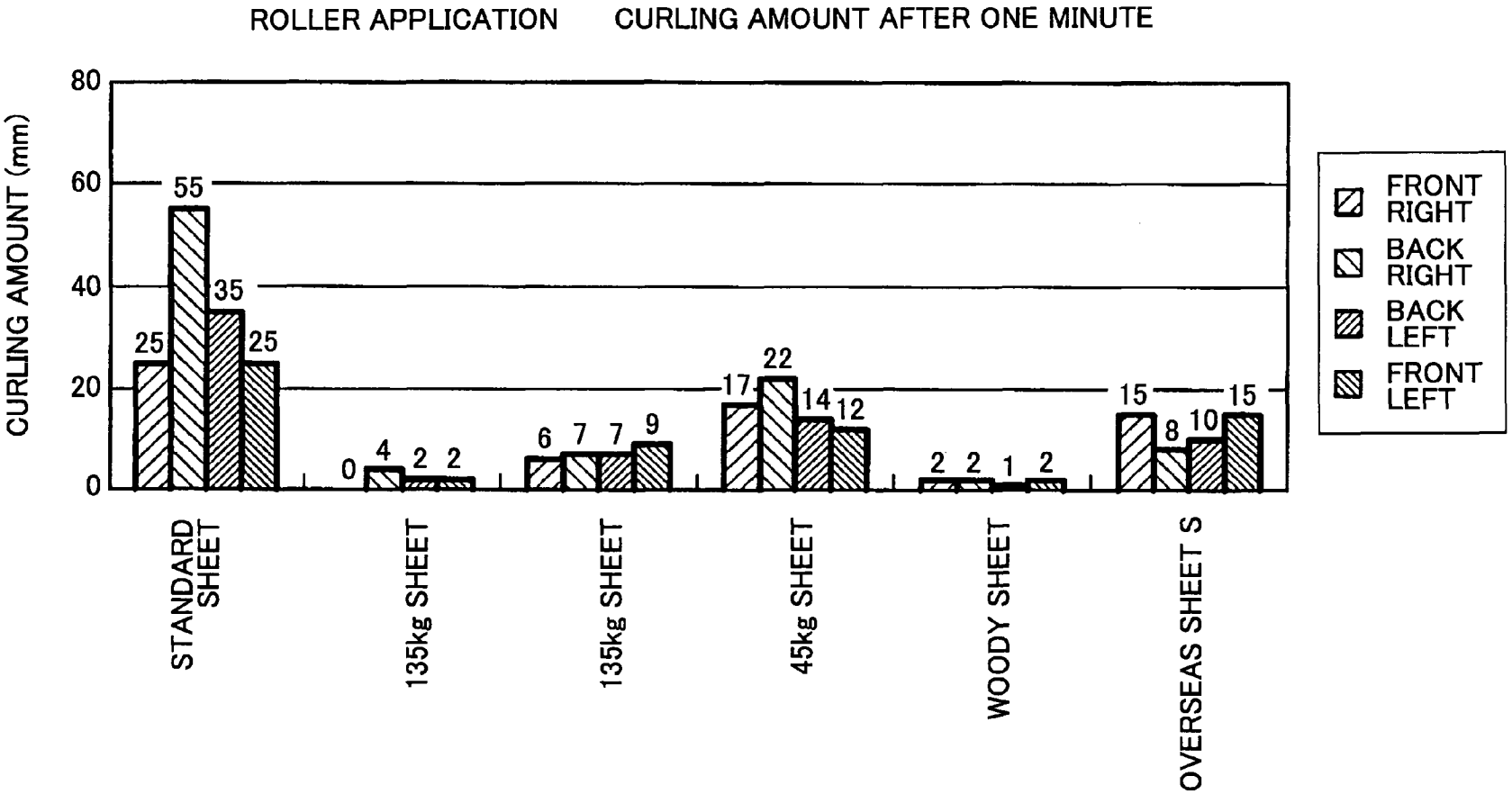
FIG. 16 is a graph indicating curling amounts of different types of sheets.
Figure 17:
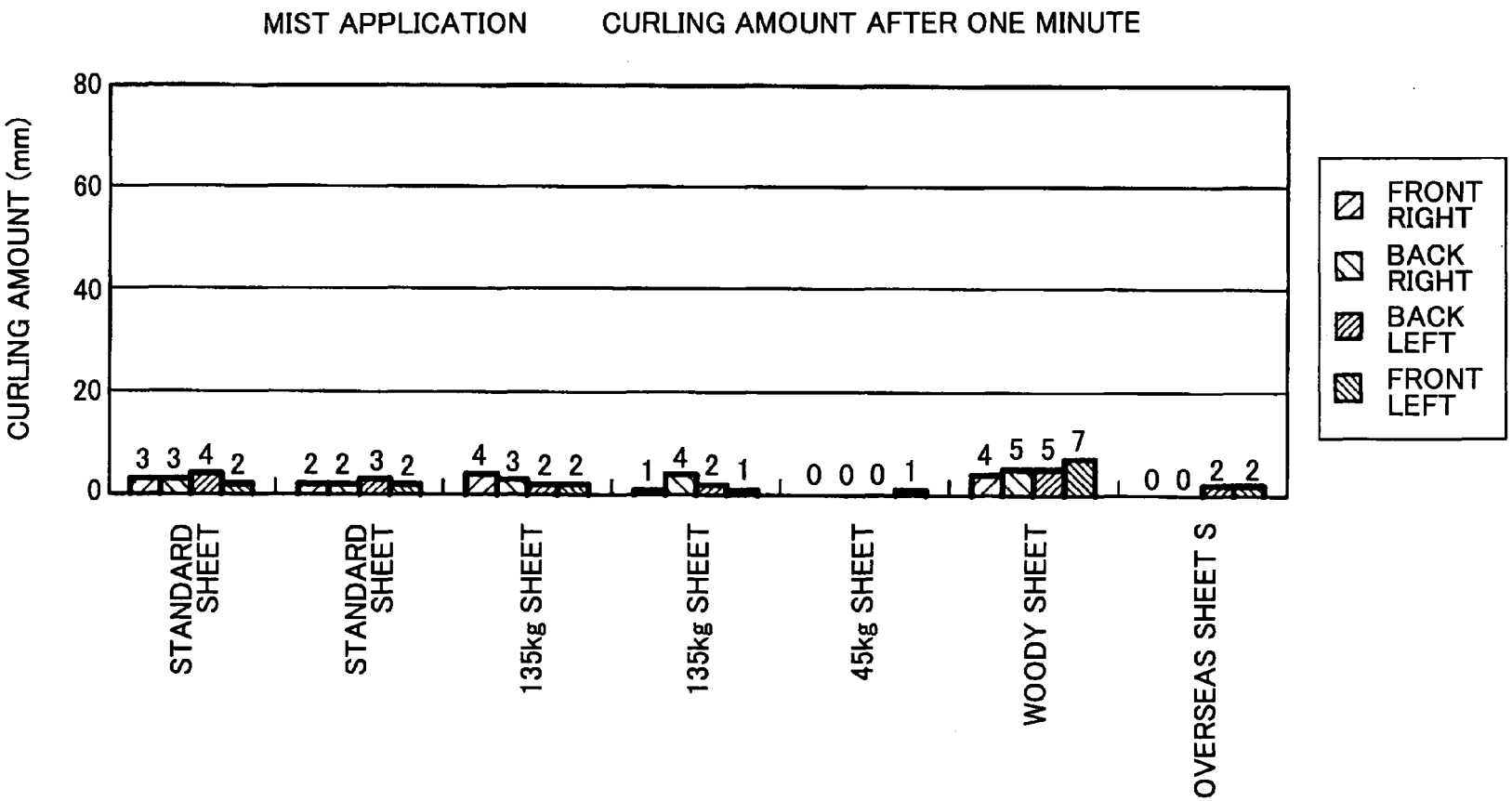
FIG. 17 is a graph indicating curling amounts of different types of sheets when the fixing device according to an embodiment of the present invention is employed.

With the configuration according to an embodiment of the present invention, when the liquid is pulled by a Coulomb force from behind the sheet 117, the curling phenomenon can be considerably mitigated. According to experiments, it has been found that the warping amount of the sheet 117 after liquid application is reduced from 1/6 to 1/10, although this may vary depending on the paper type. FIG. 16 is a graph indicating curling amounts obtained as experimental results. The graph indicates the curling amounts of different types of sheets obtained after 0.1 g of water was uniformly applied onto an A4-sized sheet with a roller. The curling amount varied depending on the paper type. The largest curling amount was 50 mm, which considerably degrades the usability and the commercial value of the sheet. FIG. 17 is a graph indicating the curling amounts after the same amount of water was applied by the method according to an embodiment of the present invention. The curling phenomenon occurs when the fiber expands on the side of the sheet 117 to which the liquid is adhering, causing a difference in the fiber size between the back side. However, in the method according to an embodiment of the present invention, the adhering water is further attracted toward the back side of the sheet 117 by a Coulomb force with the use of the recording material charging unit 136, so that the liquid permeates to the back side of the sheet 117. As a result, the density of the water becomes the same on the front side and the back side of the sheet 117, and therefore, the curling phenomenon is mitigated.

In a conventional copier employing the heat fixing method, the recording material enters a fixing device using heat at the final stage. However, the heat fixing method consumes an extremely large amount of power as it involves a heating operation. Furthermore, even while the copier is not being used, the heater needs to be maintained at a considerably high temperature to reduce the time required for starting up. Thus, the copier consumes a considerable amount of power when it is operating, even in a standby status. Conversely, in the fixing method using the fixing liquid according to an embodiment of the present invention, the fixing device 118 consumes low power during operation, and consumes substantially no power in a standby status.

Figure 18:
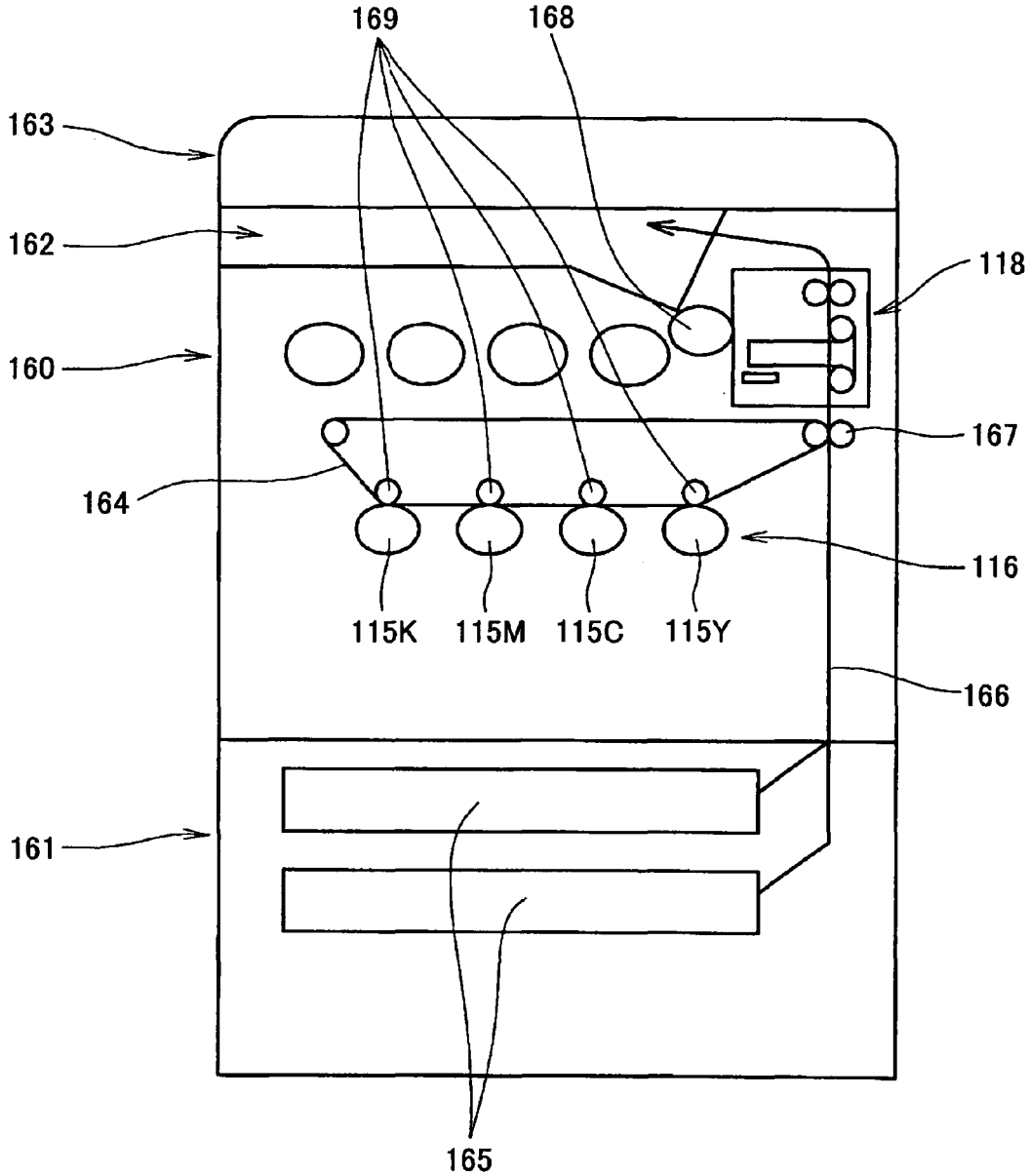
FIG. 18 illustrates another example of an image forming apparatus equipped with the fixing device according to an embodiment of the present invention.

FIG. 18 illustrates another example of an image forming apparatus equipped with the fixing device 118 according to an embodiment of the present invention.

The image forming apparatus shown in FIG. 18 is an electrophotographic tandem-type color image forming apparatus employing an indirect transfer method in which a toner image on an image carrier is first transferred onto an intermediate transfer body in a primary transfer operation, and then the toner image on the intermediate transfer body is transferred onto a recording material in a secondary transfer operation.

In FIG. 18, the reference numeral 160 denotes a main body of the image forming apparatus, which is mounted on a sheet feeding device 161. The image forming apparatus main body 160 includes an in-body sheet ejection unit 162. An image scanning device 163 is mounted on the image forming apparatus main body 160. In the image forming apparatus main body 160, a belt-type intermediate transfer body 164 is rotatably wound around a plurality of rollers. Beneath the horizontal portion of the intermediate transfer body 164 stretched between the rollers, there are provided the four image creating units 115K, 115M, 115C, and 115Y, arranged horizontally. These image creating units are included in the tandem image creating device 116.

In the sheet feeding device 161, there are provided plural recording material containers 165. A recording material conveyance path 166 extends from the top right portion of each of the recording material containers 165. On the recording material conveyance path 166, a secondary transfer unit 167 is provided facing the intermediate transfer body 164. The fixing device 118 is provided downstream of the secondary transfer unit 167. A fixing liquid storing unit 168 is provided adjacent to the fixing device 118.

Toner images created by the image creating units 115K, 115M, 115C, and 115Y are transferred onto the intermediate transfer body 164 by primary transfer units 169 in a primary transfer operation. Meanwhile, a recording material sent out from the recording material containers 165 is conveyed to a secondary transfer position through the recording material conveyance path 166. At the secondary transfer position, the toner image on the intermediate transfer body 164 is transferred onto the recording material by the secondary transfer unit 167 in a secondary transfer operation. After the image has been transferred onto the recording material, the recording material passes through the fixing device 118 so that the transferred image is fixed, and is then ejected to the in-body sheet ejection unit 162.

Figure 19:
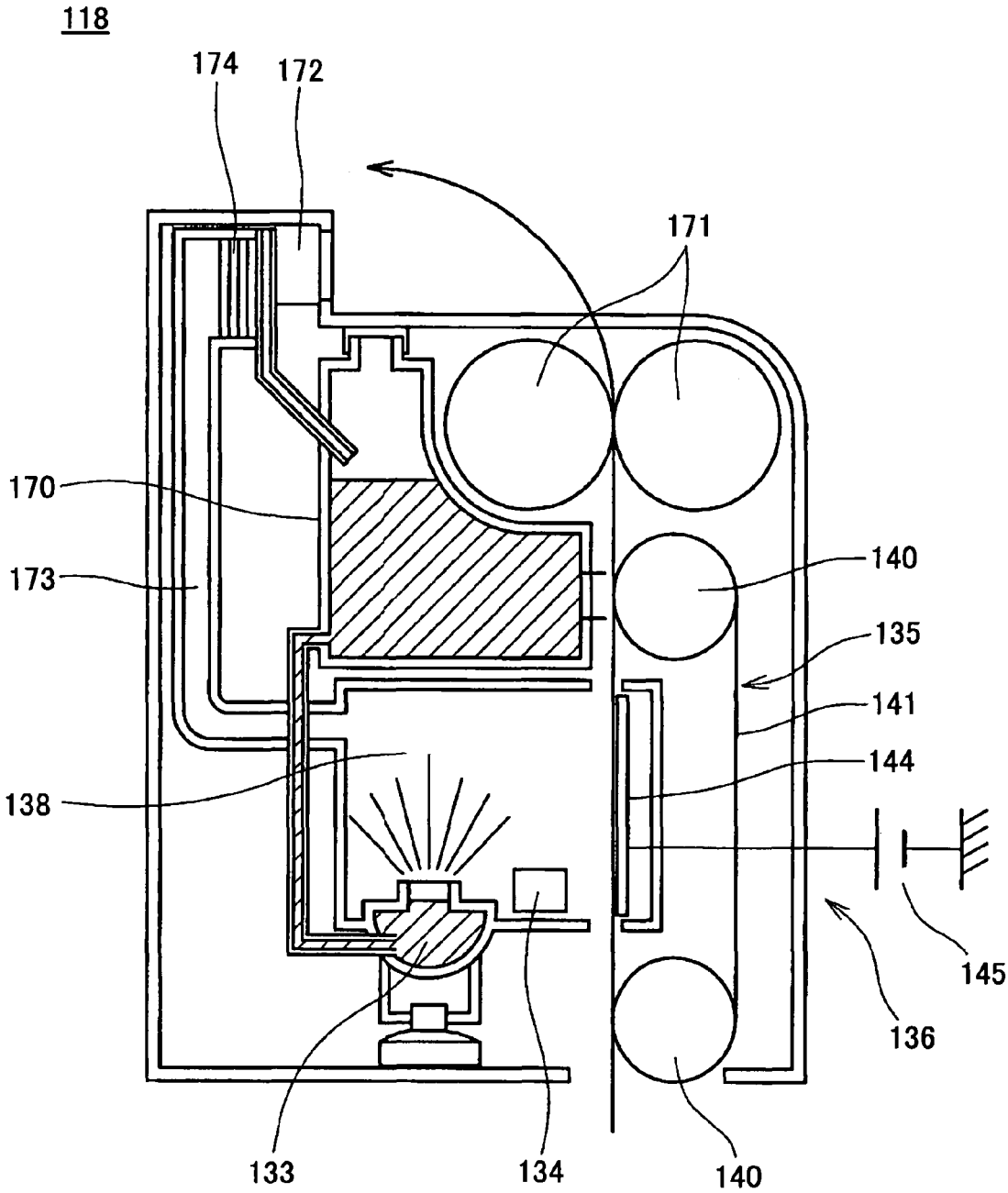
FIG. 19 illustrates the fixing device provided in the image forming apparatus shown in FIG. 18.

FIG. 19 illustrates the fixing device 118 provided in the image forming apparatus shown in FIG. 18.

The fixing device 118 includes the spraying unit 133 that sprays the toner fixing liquid as fixing liquid droplets, the liquid droplet charging unit 134 for applying a negative charge to the fixing liquid droplets sprayed by the spraying unit 133, which negative charge has the same polarity as the unfixed toner, the medium conveying unit 135 for conveying the recording material on which unfixed toner is placed through an atmosphere with fixing liquid droplets charged by the liquid droplet charging unit 134, and the recording material charging unit 136 for applying a positive charge to the recording material being conveyed by the medium conveying unit 135, which positive charge has a polarity opposite to that of the unfixed toner and the fixing liquid droplets.

The spraying unit 133 fills the spraying chamber 138 with fixing liquid droplets by spraying the fixing liquid stored in a fixing liquid storing tank 170 as a dry mist with each droplet diameter being 15 μm or less, with the use of ultrasonic waves. The fixing liquid storing tank 170 is replenished with fixing liquid by the fixing liquid storing unit 168. An ionizer is used as the liquid droplet charging unit 134 for charging the fixing liquid droplets floating in the spraying chamber 138.

The medium conveying unit 135 includes the plural rollers 140 and the conveying belt 141 wound around the rollers 140. The conveying belt 141 conveys the recording material while the recording material is electrostatically adhering to the conveying belt 141 in an upright manner defying gravity. On the downstream side, there is provided a pair of pressurizing rollers 171 for pressurizing the recording material to enhance the fixing force and color reproducibility.

The recording material charging unit 136 includes the electrode 144 arranged on the inside of the conveying belt 141 wound around the rollers 140 and the power source 145 connected to the electrode 144. The fixing liquid droplets are attracted in the direction of the recording material by a Coulomb force, and therefore, as shown in FIG. 12B, the fixing liquid droplets 153 and the unfixed toner 142 adhere to the sheet 117. In this example, the liquid droplets remaining in the spraying chamber 138 are collected by being suctioned by a fan 172 through a collecting pipe 173, filtered by a filter 174, and returned to the fixing liquid storing tank 170 in order to be reused.

Similar to the above example, in this example, the liquid droplet charging unit 134 charges the fixing liquid droplets sprayed by the spraying unit 133 to make them have the same polarity as that of the unfixed toner on the recording material. The medium conveying unit 135 conveys the recording material on which the unfixed toner is placed through the atmosphere including the charged fixing liquid droplets. The recording material charging unit 136 charges the conveyed recording material to make it have a polarity opposite to those of the unfixed toner and the fixing liquid droplets. By being forcibly attracted by a Coulomb force, the unfixed toner and fixing liquid droplets adhere to the recording material. The unfixed toner is softened by the softening agent in the fixing liquid and is fixed to the recording material.

Accordingly, the unfixed toner on the recording material is electrostatically attracted toward the recording material that is charged to an opposite polarity. Therefore, the unfixed toner on the recording material is prevented from scattering so that the toner image does not become distorted, and a fixing operation can be performed in a favorable manner without decreasing image quality. Furthermore, the fixing liquid droplets are electrostatically attracted to the recording material that is charged to an opposite polarity. Hence, the fixing liquid droplets uniformly adhere to the recording material without being wasted and without fixing irregularities, and the fixing liquid is used effectively so that consumption of the fixing liquid is reduced. Moreover, the fixing liquid droplets adhering to the recording material are further electrostatically attracted so that they reach the backside of the recording material. Hence, the density of the fixing liquid is made equal on the front side and the back side of the recording material, thereby mitigating a curling phenomenon of the recording material.

According to one embodiment of the present invention, in a fixing device for fixing unfixed toner onto a recording sheet with the use of toner fixing liquid including a softening agent for softening toner, the fixing device includes a sprayer configured to spray the toner fixing liquid as liquid droplets; and an electrode configured to apply an electric charge to the sprayed liquid droplets. The sprayer sprays the liquid droplets onto the unfixed toner placed on the recording sheet; and the electrode applies, to the sprayed liquid droplets, an electric charge of an electric charge polarity opposite to that of the unfixed toner.

Additionally, the sprayer includes a piezo element; and the sprayer sprays the toner fixing liquid with the use of oscillation of the piezo element.

Additionally, a driving frequency of the piezo element falls in a range of 300 kHz through 1 MHz.

Additionally, the diameter of the liquid droplets sprayed by the sprayer falls in a range of 4 μm through 10 μm.

Additionally, the fixing device further includes a spray chamber configured to be filled with the liquid droplets; and an exhaust duct configured to collect the liquid droplets inside the spray chamber. The collected liquid droplets are reused.

Additionally, the fixing device further includes a pressurizing roller configured to apply pressure to the recording sheet after the toner has been fixed on the recording sheet with the use of the toner fixing liquid.

According to one embodiment of the present invention, an image forming apparatus includes any of the above-described fixing devices.

According to one embodiment of the present invention, in a fixing device for fixing unfixed toner onto a recording material such as a sheet or an OHP transparency by applying toner fixing liquid, the toner fixing liquid including a softening agent for softening the unfixed toner and a solvent for dissolving or dispersing the softening agent, the fixing device includes a sprayer configured to spray the toner fixing liquid as fixing liquid droplets; a liquid droplet charging unit such as an ionizer configured to apply, to the fixing liquid droplets sprayed by the sprayer, an electric charge of the same polarity as that of the unfixed toner; a medium conveying unit configured to convey the recording material on which the unfixed toner is placed through an atmosphere including the fixing liquid droplets to which the electric charge is applied by the liquid droplet charging unit; and a recording material charging unit configured to charge the recording material being conveyed by the medium conveying unit to a polarity opposite to those of the unfixed toner and the fixing liquid droplets.

Furthermore, the liquid droplet charging unit applies, to the fixing liquid droplets sprayed by the sprayer, an electric charge of the same polarity as that of the unfixed toner; the medium conveying unit conveys the recording material on which the unfixed toner is placed through an atmosphere including the fixing liquid droplets to which the electric charge is applied; the recording material charging unit charges the recording material being conveyed to a polarity opposite to those of the unfixed toner and the fixing liquid droplets; the unfixed toner and the fixing liquid droplets are forcibly attracted by a Coulomb force to adhere to the recording material; and the unfixed toner is softened by the softening agent in the toner fixing liquid and fixed to the recording material.

Additionally, the sprayer sprays the toner fixing liquid as the fixing liquid droplets with diameters having a mode value of 15 μm or less.

Furthermore, the sprayed fixing liquid droplets uniformly float in midair as a dry mist and adhere to the recording material without being wasted and without irregularities.

Additionally, the medium conveying unit includes plural rollers; and a conveying belt wound around the rollers and configured to convey the recording material electrostatically adhering to the conveying belt.

Furthermore, the rollers are driven so that the conveying belt is conveyed and the recording material on which the unfixed toner is placed, which recording material is electrostatically adhering to the conveying belt, is conveyed by the conveying belt.

Additionally, the recording material charging unit includes an electrode provided on the inside of the conveying belt wound around the rollers; and a power source connected to the electrode.

Furthermore, the power source applies a voltage to the electrode provided on the inside of the conveying belt so that the recording material conveyed by the conveying belt can be charged to a polarity opposite to that of the unfixed toner and the fixing liquid droplets.

Additionally, the recording material charging unit includes the conveying belt wound around the rollers; and an application unit configured to apply an electric charge to the conveying belt to charge the recording material to the polarity opposite to those of the unfixed toner and the fixing liquid droplets.

Furthermore, the application unit applies the electric charge to the conveying belt, so that the recording material conveyed by the conveying belt is charged to a polarity opposite to that of the unfixed toner and the fixing liquid droplets.

Additionally, the fixing device includes a spray chamber. The sprayer sprays the fixing liquid droplets into the spray chamber; the liquid droplet charging unit applies the electric charge to the fixing liquid droplets so that the spray chamber is filled with the fixing liquid droplets charged to the same polarity as that of the unfixed toner; and the medium conveying unit conveys the recording material through the atmosphere including the fixing liquid droplets in the spray chamber.

Furthermore, the sprayer sprays the fixing liquid droplets into the spray chamber, the liquid droplet charging unit applies the electric charge to the fixing liquid droplets so that the spray chamber is filled with the fixing liquid droplets charged to the same polarity as that of the unfixed toner, and the medium conveying unit conveys the recording material through the atmosphere with the fixing liquid droplets in the spray chamber.

Additionally, an average diameter d [μm] of the fixing liquid droplets is determined as $30{,}000\times(Q/S)\leqq d\leqq 15$ μm, where an area on the recording material that needs to be covered by the toner fixing liquid is S [$cm^2$] and an application amount of toner fixing liquid onto the recording material is Q [g].

Furthermore, an appropriate amount of small fixing liquid droplets are sprayed in accordance with the area on the recording material that needs to be covered by the fixing liquid, the sprayed fixing liquid droplets uniformly float in midair as a dry mist, and the fixing liquid droplets adhere to the recording material without being wasted and without causing fixing irregularities.

According to one embodiment of the present invention, an image forming apparatus, such as a copier, a printer, a facsimile machine, or a multifunction peripheral provided with these functions, includes an image creating unit configured to create a toner image on an image carrier such as a photoconductor or an intermediate transfer body; a transfer unit configured to transfer the toner image created by the image creating unit from the image carrier to the recording material; and the fixing device described above, configured to fix, onto the recording material, the unfixed toner of the toner image transferred by the transfer unit.

Furthermore, the image creating unit creates the toner image on the image carrier; the transfer unit transfers the toner image from the image carrier to the recording material; the medium conveying unit conveys the recording material on which the unfixed toner is placed through the atmosphere in the fixing device including the fixing liquid droplets to which the electric charge is applied; the recording material charging unit in the fixing device charges the recording material being conveyed to a polarity opposite to those of the unfixed toner and the fixing liquid droplets; the unfixed toner adheres to the recording material; and the fixing liquid droplets sprayed by the sprayer and charged to the same polarity as the unfixed toner by the liquid droplet charging unit adhere to the recording material.

According to one embodiment of the present invention, an image forming apparatus, such as a copier, a printer, a facsimile machine, or a multifunction peripheral provided with these functions, includes an image creating unit configured to create a toner image on an image carrier such as a photoconductor or an intermediate transfer body; a primary transfer unit configured to transfer the toner image created by the image creating unit from the image carrier to an intermediate transfer body in a primary transfer operation; a secondary transfer unit configured to transfer the toner image transferred by the primary transfer unit from the intermediate transfer body to the recording material in a secondary transfer operation; and the fixing device described above, configured to fix, onto the recording material, the unfixed toner of the toner image transferred by the secondary transfer unit.

Furthermore, the image creating unit creates the toner image on the image carrier; the primary transfer unit transfers the toner image from the image carrier to the intermediate transfer body in the primary transfer operation; the secondary transfer unit transfers the toner image from the intermediate transfer body to the recording material in the secondary transfer operation; the medium conveying unit conveys the recording material on which the unfixed toner is placed, which unfixed toner is transferred by the secondary transfer unit in the secondary transfer operation, through the atmosphere in the fixing device including the fixing liquid droplets to which the electric charge is applied; the recording material charging unit in the fixing device charges the recording material being conveyed to a polarity opposite to those of the unfixed toner and the fixing liquid droplets; the unfixed toner adheres to the recording material; and the fixing liquid droplets sprayed by the sprayer and charged to the same polarity as the unfixed toner by the liquid droplet charging unit adhere to the recording material.

The present invention is not limited to the specifically disclosed embodiment, and variations and modifications may be made without departing from the scope of the present invention.

The present application is based on Japanese Priority Patent Application No. 2006-244868, filed on Sep. 8, 2006 and Japanese Priority Patent Application No. 2007-121476, filed on May 2, 2007, the entire contents of which are hereby incorporated by reference.

What is claimed is:

1. A fixing device for fixing unfixed toner onto a recording material by applying toner fixing liquid, the toner fixing liquid comprising a softening agent for softening the unfixed toner and a solvent for dissolving or dispersing the softening agent, the fixing device comprising:

a sprayer configured to spray the toner fixing liquid as fixing liquid droplets;

a liquid droplet charging unit configured to apply, to the fixing liquid droplets sprayed by the sprayer, an electric charge of the same polarity as that of the unfixed toner;

a medium conveying unit configured to convey the recording material on which the unfixed toner is placed through an atmosphere comprising the fixing liquid droplets to which the electric charge is applied by the liquid droplet charging unit; and a recording material charging unit configured to charge the recording material being conveyed by the medium conveying unit to a polarity opposite to those of the unfixed toner and the fixing liquid droplets.

2. The fixing device according to claim 1, wherein:

the sprayer sprays the toner fixing liquid as the fixing liquid droplets with diameters having a mode value of 15 μm or less.

3. The fixing device according to claim 1, wherein the medium conveying unit comprises:

plural rollers; and a conveying belt wound around the rollers and configured to convey the recording material electrostatically adhering to the conveying belt.

4. The fixing device according to claim 3, wherein the recording material charging unit comprises:

an electrode provided on the inside of the conveying belt wound around the rollers; and a power source connected to the electrode.

5. The fixing device according to claim 3, wherein the recording material charging unit comprises:

the conveying belt wound around the rollers; and an application unit configured to apply an electric charge to the conveying belt to charge the recording material to the polarity opposite to those of the unfixed toner and the fixing liquid droplets.

6. The fixing device according to claim 1, further comprising:

a spray chamber, wherein:

the sprayer sprays the fixing liquid droplets into the spray chamber;

the liquid droplet charging unit applies the electric charge to the fixing liquid droplets so that the spray chamber is filled with the fixing liquid droplets charged to the same polarity as that of the unfixed toner; and the medium conveying unit conveys the recording material through the atmosphere comprising the fixing liquid droplets in the spray chamber.

7. The fixing device according to claim 1, wherein:

an average diameter d [μm] of the fixing liquid droplets is determined as $30{,}000\times(Q/S)\leqq d\leqq 15$ μm where an area on the recording material that needs to be covered by the toner fixing liquid is S [$cm^2$] and an application amount of toner fixing liquid onto the recording material is Q [g].

8. An image forming apparatus comprising:

an image creating unit configured to create a toner image on an image carrier;

a transfer unit configured to transfer the toner image created by the image creating unit from the image carrier to the recording material; and the fixing device according to claim 1, configured to fix, onto the recording material, the unfixed toner of the toner image transferred by the transfer unit.

9. An image forming apparatus comprising:

an image creating unit configured to create a toner image on an image carrier;

a primary transfer unit configured to transfer the toner image created by the image creating unit from the image carrier to an intermediate transfer body in a primary transfer operation;

a secondary transfer unit configured to transfer the toner image transferred by the primary transfer unit from the intermediate transfer body to the recording material in a secondary transfer operation; and the fixing device according to claim 1, configured to fix, onto the recording material, the unfixed toner of the toner image transferred by the secondary transfer unit.

* * * * *